US006497281B2

(12) United States Patent
Vann

(10) Patent No.: US 6,497,281 B2
(45) Date of Patent: Dec. 24, 2002

(54) CABLE ACTUATED DOWNHOLE SMART PUMP

(76) Inventor: Roy R. Vann, 9517 Tosha La., Flint, TX (US) 75762

( * ) Notice: Subject to any disclaimer, the term of this patent is extended or adjusted under 35 U.S.C. 154(b) by 0 days.

(21) Appl. No.: 09/911,322

(22) Filed: Jul. 23, 2001

(65) Prior Publication Data

US 2002/0007952 A1 Jan. 24, 2002

Related U.S. Application Data

(60) Provisional application No. 60/220,414, filed on Jul. 24, 2000, and provisional application No. 60/220,361, filed on Jul. 24, 2000.

(51) Int. Cl.[7] ..... E21B 43/00; E21B 43/16

(52) U.S. Cl. ..... 166/250.15; 166/369; 166/68.5; 166/105

(58) Field of Search ..... 166/250.03, 250.15, 166/302, 304, 53, 66, 68.5, 105, 105.5, 369

(56) References Cited

U.S. PATENT DOCUMENTS 1,970,596 A 8/1934 Coberly
4,666,375 A * 5/1987 Kime ..... 417/46
4,761,120 A 8/1988 Mayer
4,973,226 A 11/1990 McKee
5,141,411 A * 8/1992 Klaeger ..... 417/445
5,318,409 A * 6/1994 London et al. ..... 417/53
5,372,482 A 12/1994 London

* cited by examiner

*Primary Examiner*—William P. Neuder
(74) *Attorney, Agent, or Firm*—Marcus L. Bates

(57) ABSTRACT

Improvements in method and apparatus for producing hydrocarbons from marginal oil wells, especially wells that previously used standard pump jacks. Substitution of the present invention for prior art production equipment solves many common problems found in the prior art, such as a well pump that experiences gas lock and pounding, which is a hindrance to efficient production in other known pump systems but is advantageous when using the Smart Pump of this disclosure. Disclosed herein is a pump assembly which senses when fluid is pumped uphole at a rate different than the rate that fluid is produced from the formation, by continually adjusting the time interval of one cycle of operation to coincide with the production history of the well. Stored data related to the production history of the well enables determination of the quantity of fluid that should be contained within the pump barrel each cycle of operation and changes the time interval for successive cycles of operation so as to continually adjust the next time interval to coincide with the rate of production of the formation whereby the optimum rate of production is always attained by this method of operation of the apparatus disclosed herein. These and many other unforseen advantages are realized by this disclosure that can change an unprofitable well into a profitable well, often at no additional cost.

33 Claims, 12 Drawing Sheets

CABLE ACTUATED DOWNHOLE SMART PUMP

This application claims the benefit of provisional applications Nos. 60/220,414 and 60/220,361 both filed Jul. 24, 2000.

BACKGROUND OF THE INVENTION

The present invention relates to improvements in downhole production pumps and operating systems therefor for use in pumping fluids from boreholes and especially an oil well production system for stripper wells wherein crude oil is removed from the borehole as fast as it comes into the well.

Marginal oil wells, also called stripper wells, are usually uneconomical for the major oil companies to operate because the labor and pumping costs are close to the revenue from the hydrocarbon sales. Every day many of these unprofitable stripper wells are being shut in, plugged, and abandoned. But there is a type of oil field hand that loves to get possession of these marginal wells because he has the where-with-all to scrounge up enough equipment to maintain and operate these wells at a small profit.

Many of these stripper wells in the U.S.A. produce only about 10 barrels or less, of hydrocarbons/day. These wells are important to the U.S. economy, especially during times of political unrest when they become vital to our national defense. After all, just one days production at a rate of 10 barrels, or 440 gal, of oil/day will operate a small auto several thousand miles after the crude oil has been refined into fuel.

Accordingly, it is desirable to make available novel oil well production equipment that is relatively inexpensive and can be assembled from mostly commercially available material and thereby increase the profit gleaned from a stripper well. Additionally, the novel equipment should be easy to work on and have low cost maintenance and operation. Further, the novel equipment should operate the well in such a manner that the production rate can be increased from marginal to profitable. When all of these and several other desirable attributes are considered, it is easy to see that they add up to a novel well production system that provides the unexpected result of changing an unprofitable situation into one that is profitable.

Most oil wells in West Texas are produced by a pump-jack unit that reciprocates a bottom hole pump. The pump-jack usually operates cyclically for time intervals selected to avoid reaching a pump-off condition which starts a destructive condition known as fluid pounding, or gas lock. This situation is evidenced by the hundreds of issued US Patents which address this problem. One simply never pumps-off a well.

Fluid pounding is encountered when a pump-off condition is reached due to the attempt to remove downhole fluid from the borehole faster than it can accumulate. This introduces compressible gas into the variable chamber of the downhole pump, causing the plunger to accelerate and "pound" the bottom of the pump as the liquid supported by the plunger impacts the stationary valve assembly at the bottom of the pump barrel. Fluid pounding is destructive for it can result in accelerated wear and tear on the entire production equipment. Therefore, in most reciprocating downhole production pumps, a lot of consideration is given to avoiding a pump-off condition of the downhole pump.

Contrary to the prior art method of producing a well, the production system of the present invention is operated in a continually pumped-off condition by removing the formation fluid from the bottom of the well just as fast as it enters through the casing perforations of the borehole, thereby reducing the hydrostatic pressure against the pay zone to a minimum. This allows the oil bearing formation to produce at its maximum, but at the same time it is bound to ingest compressible gas into the bottom of the pump barrel, where it would be expected to cause fluid pounding, especially if provision is not made to avoid this occurrence. Accordingly, a purpose of this invention is the provision of a novel downhole pump and system that can accommodate the pumping of mixed hydrocarbon fluids (gas and liquid) and thereby change the problem of encountering a pump-off condition into an asset, while avoiding the dangers of fluid pounding. This is achieved in accordance with the present invention by the provision of a downhole pump assembly having a very long barrel that lifts both gas and liquid uphole every up-stroke of the pump plunger so that the pump chamber does not accumulate compressible fluids therewithin, but instead exhausts all gases along with the liquid each upstroke of the pump.

In addition to avoiding fluid pounding, this novel feature of this invention also has the unexpected advantage of enhancing pumping efficiency by using the gas expelled from the pump into the production tubing to provide additional lifting power in the manner similar to a well that uses a gas or air lift to produce liquid therefrom. Hence, gas that flows into the pump apparatus of this disclosure is slowly exhausted from the top of the variable chamber each upstroke of the pump plunger, and consequently there is no means by which the gas from a previous stroke can accumulate in the pump barrel for another stroke because the gas is removed from the pump apparatus at the end of each upstroke. Accordingly, fluid pounding is never encountered.

Further, the exceedingly long stroking pump plunger, together with the unusually slow time interval of the upstroke each cycle of operation, provides the necessary time delay for any gas that flows into the pump chamber to separate from the fluid and accumulate at the top of the barrel. During the slow plunger up-stroke the accumulated gas is slowly expelled from the pump variable chamber and enters the bottom of the production string at a very slow rate, which reduces the density of the contents of the tubing.

During the upstroke, the slow traveling pump plunger is acting against a constant lifting force and therefore does not accelerate significantly due to the differences in design between the system of this invention and the prior art production pumps, as will be more fully appreciated later on as this disclosure is more fully digested. Stated differently, there is not enough plunger speed and built-in inertia force in the present system as compared to the massive rotating parts of a prior art pumpjack operation to effect fluid pounding. Further, the low pumping speed of this novel cyclic operation along with the low bottom hole pressure at the perforations prevents accumulation of gases within the pump barrel for more than one cycle of operation, and this is a situation in which fluid pounding cannot be brought about.

Another novel feature of this disclosure is the provision of a method which reduces the oil/water ratio to a minimum by skimming the oil from above the oil/water interface of the formation fluid accumulated in the bottom of the well. The amount of water produced can be reduced until the desired crude production is achieved, or the desired oil/water ratio is achieved.

Other advantages of this disclosure over rod type downhole pumps is that the downhole production pump apparatus claimed herein can be pulled from the tubing by using the operating cable for reeling the lifting cable uphole until the pump apparatus surfaces. Then the entire pump apparatus can be serviced, as required, with change out of desired parts, and thereafter run back downhole into the borehole by unspooling the cable. Both method and apparatus that achieves the above desirable results are the subject of this invention and for which patent protection is sought.

In the prior art, it is noted that Coberly, U.S. Pat. No. 1,970,596, discloses a cable actuated long stroke pumping mechanism having a cable drum that includes a mechanical speed and switching control means associated therewith. The cable drum is rotated such that it accelerates the rate of travel of the plunger at the end of each stroke.

Mayer, et al, U.S. Pat. No. 4,761,120, measures a load on the rod string to provide automatic shutdown of a pumping unit.

London, et al, U.S. Pat. No. 5,372,482, controls the filling of a well pumping device by an arrangement in which the motor current is measured and compared to rod position using a computer to process the signals.

McKee, U.S. Pat. No. 4,973,226 discloses a pumpjack reciprocating a sucker rod string for actuating a downhole pump by measuring load on the rod string during a downstroke position of the walking beam to provide a signal which is stored and processed by a computer to determine the filling of a pump barrel. The electrical power to the pump jack motor is controlled by the computer to control stroke speed which keeps the pump barrel full by comparing instantaneous computer generated data with previous data and to continuously correct the filling of the barrel.

BRIEF SUMMARY OF THE INVENTION

Improvements in downhole production pumps and operating systems therefor for use in pumping fluids from boreholes, and especially an oil well production system for stripper wells wherein crude oil is removed from the borehole as fast as it comes into the well. This system includes weight indicators, downhole sensing devices, including fluid level detecting devices, bottom hole pressure measurement, detection of oil/water contact or interface, and a cable actuated downhole production pump that can handle both oil and gas. All of these system parts are assembled and programmed to operate a novel downhole production pump at a production rate equal to the flow rate of the produced oil flowing into the well bore from the casing perforations. This keeps the hydrostatic head at the perforations at a minimum value which can be substantially zero, so that the downhole hydrostatic pressure imposed on the production zone is relatively low, which is a condition that achieves maximum production of oil from an oil well.

Reduced power consumption is realized by the incorporation of a very long pump barrel having a special cable actuated lifting plunger received therein that is slowly reciprocated uphole and then lowered back into the well 24 hours per day. This novel lifting system is designed for maximum efficiency as well as increased recovery of oil from old stripper wells; especially old wells that have declined in yearly production to only 10 barrels of oil per day or less, for example, when using conventional pump systems. Properly installed, the system set forth in this disclosure could significantly increase present production in old stripper wells while at the same time reducing the cost of operation.

Sensing devices are employed to control the action of the production apparatus which enables the speed of the operation to be controlled to match the rate of fluid input into the well bore at the casing perforations, thereby saving energy by allowing the pump to operate in a timed cyclic mode which upstrokes after there is a predetermined accumulation of production fluid in the pump barrel ready to be removed from the bottom of the borehole.

Accordingly, each time the operating cable is lowered into the borehole, diagnosis by the surface equipment determines the downhole fluid level, and, when there is less than a full pump barrel of formation fluid available to be transferred into the pump barrel, the timing of the next operating cycle is modified to coincide with the formation production rate so that a full pump barrel is attained prior to each upstroke. This additional cycle time provides sufficient time for the well to make the additional fluid needed to completely fill the pump barrel with the accumulated well fluid and further keeps a minimum hydrostatic head at the perforations.

Many unprofitable stripper wells can be operated profitably by judiciously diagnosing the operating history of the well and carrying out any future operation of the well in accordance with this invention.

Therefore, a primary object of the present invention is the provision of both method and apparatus of a pump system made in accordance with this disclosure that employs a cyclicly continuously operated slow moving, long stroking plunger on the upstroke and on the downstroke to save power by moving a relatively large column of fluid uphole each upstroke of the plunger as contrasted to a short stroking pump, such as a pumpjack, which has a fast moving short stroking plunger on both the upstroke and downstroke.

Another object of the present invention is the provision of a cable actuated downhole pump assembly that forces an unusual quantity of fluid uphole on the upstroke while overcoming inertia one time instead of several times for the same quantity of production fluid.

A further object of the present invention is the provision of a cable actuated downhole pump assembly that easily can be pulled for servicing by reeling or spooling the lifting cable uphole until the pump barrel surfaces and then, after changing out various parts, the pump easily is run back into the hole on the operating cable; thus avoiding the necessary expense of using a pulling unit.

Another and still further object of this invention is the provision of a downhole pump assembly having a unique bypass valve device that is opened in response to the pump barrel initially being lifted uphole by the operating cable and thereby equalizes the pressure between the tubing and the casing annulus, and also washes debris from the lower end of the pump assembly in proximity of the hold-down, all of which avoids a stuck pump.

A still further object of the present invention is the provision of a downhole pump assembly having a plurality of sensor devices uniquely connected to an uphole controller to monitor the pumping operation and enable selection of the optimum time intervals for making a relative slow upstroke, followed by a downstroke of another timed interval; with this cyclic operation being modified by the controller each cycle of operation to maintain a continuous optimum production as conditions change.

A still further object of the invention is a pumping system that skims oil from a hydrocarbon producing well by allowing the pump plunger to descend through the oil phase in the pump barrel and stop at the oil/water interface, thereby producing or skimming hydrocarbons (oil and gas) without producing excessive water.

A still further object of the present invention is the provision of a downhole pump assembly operated in a manner to keep the hydrostatic head in front of each perforation at a minimum so that the fluid from the pay zone is free to flow into the wellbore without being held back by an excessive fluid hydrostatic head.

A still further object of the present invention is the provision of a downhole pump assembly operated in a manner whereby compressible fluid produced by the pay zone is admixed with liquid rather than vented up the casing string, and the mixed fluids are passed through the pumping chamber, and up the production tubing each upstroke of the pump.

A still further object of the present invention is the provision of a downhole pump assembly operated in a manner whereby fluid is pumped to the surface at the same rate that fluid is produced from a formation within a time interval of one cycle of operation calculated from stored data related to the production history of the well to determine the quantity of fluid contained within the pump each cycle of operation and to change the time interval for successive cycles of operation so as to continually adjust the time intervals to coincide with the rate of production of the formation whereby the optimum rate of production is attained and the cyclic operation continues until the well is shut down.

Another and still further object of this invention is the provision of a downhole pump assembly operated in a manner whereby there is no danger of fluid pounding, even though the well is always operated under severe pump-off conditions, because the gas ingested by the pump is slowly expelled up the production tubing each pump upstroke, and thereby enhances pumping efficiency.

A still further object of the invention is a pumping system that skims oil from a hydrocarbon producing well by allowing the pump plunger to descend through the oil phase in the pump barrel and stop adjacent the oil/water interface, thereby producing or skimming hydrocarbons (oil and gas) without producing excessive water, while the formation gas is flowed into the working chamber, and is expelled from an upper stationary valve with the production rate being held to a value that keeps the hydrostatic head in front of each perforation at a minimum so that the fluid from the pay zone is free to flow into the wellbore without being held back by an excessive fluid hydrostatic head.

A still further object of the present invention is the provision of a downhole pump assembly operated in a manner whereby compressible fluid produced by the pay zone is admixed with liquid and the mixed fluids are passed through the pumping chamber, and up the production tubing each upstroke of the pump assembly and becomes part of the fluid contained within the production tubing, thereby reducing the tubing hydrostatic pressure or fluid density and enhancing lift in a manner similar to a gas lift well.

A still further object of the present invention is the provision of a downhole pump assembly operated in a manner whereby the simplicity of design is reflected in lower initial cost and subsequent low operation maintenance, which, together with the enhanced production of the well, makes a marginal well into a profitable one.

These and various other objects and advantages of the invention will become readily apparent to those skilled in the art upon reading the following detailed description and claims and by referring to the accompanying drawings.

These and other objects are attained in accordance with the present invention by the provision of a method for use with apparatus fabricated and operated in a manner substantially as described herein.

DETAILED DESCRIPTION OF THE INVENTION

This invention pertains to a production method and apparatus for producing a well; and, more particularly to a long-stroking well production system for producing a stripper oil well. This invention employs a relatively flexible elongated member that can be spooled onto and off a drum, as for example, a wire rope or cable by which a novel downhole pump assembly can be actuated. As shown in the accompanying Figures of the drawings, and particularly FIGS. 1 and 4 thereof, there is broadly disclosed an oil well production system 10 that has the usual borehole, or wellbore having a casing 12, formed into the Earth. The production system 10, made in accordance with this invention, includes an improved surface apparatus 14 and improved subsurface apparatus 16 associated therewith for adjustably controlling the pumping action of the well in order to obtain optimum production.

Figure 1:
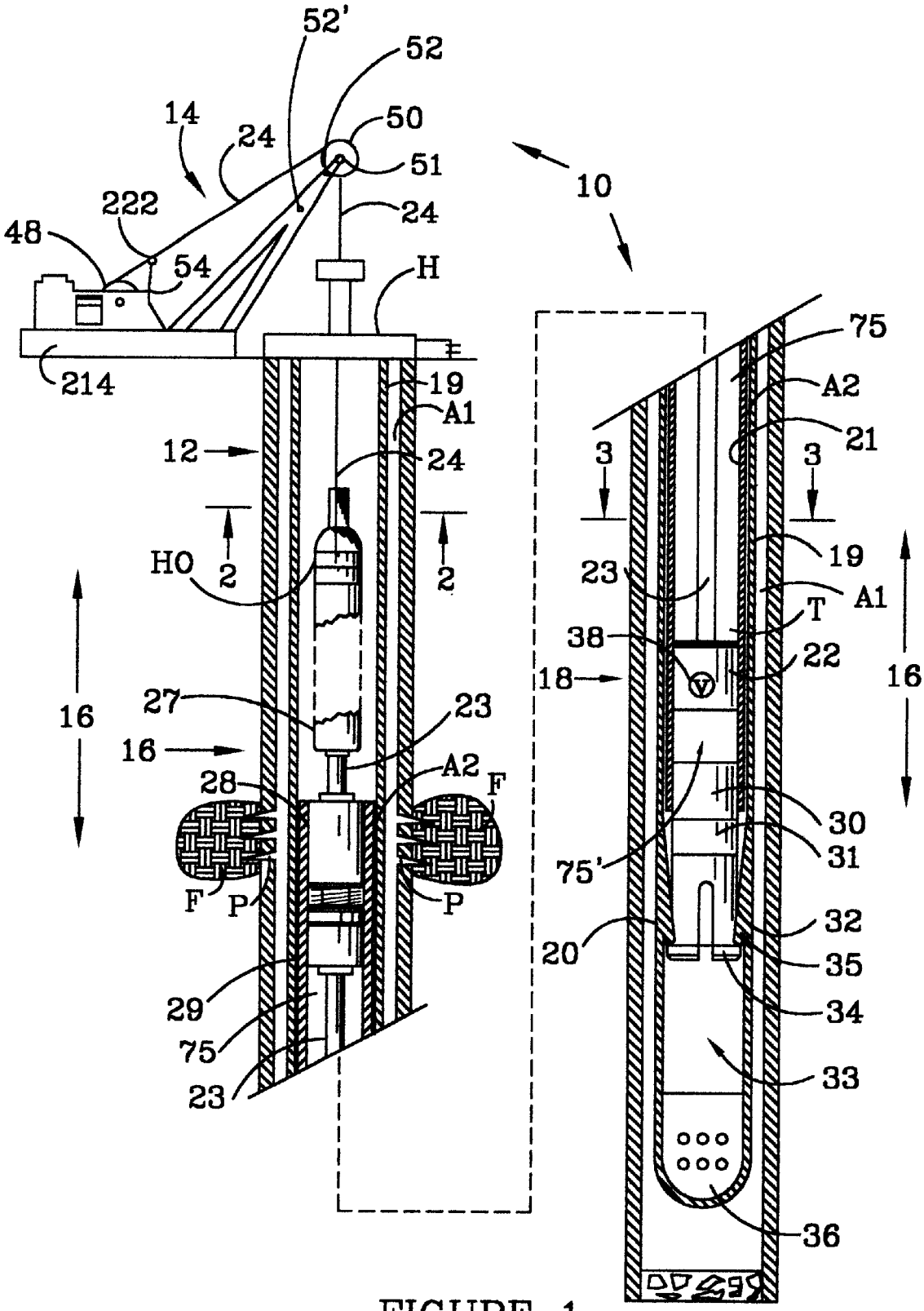
FIG. 1 is a fragmentary, part cross-sectional, part diagrammatical, part schematical, side view of a wellbore formed into the earth, having apparatus made in accordance with this invention disclosed therewith; and by which the method of this invention can be practiced.
Figure 2:
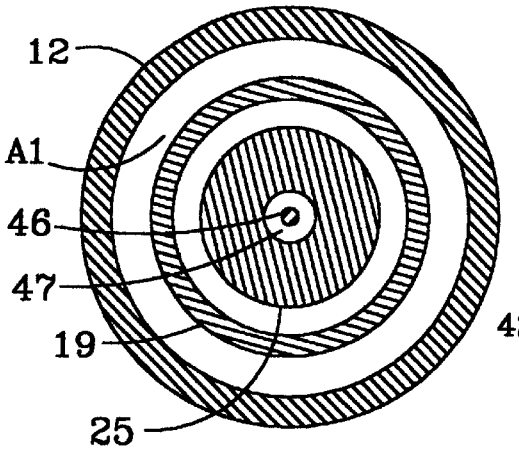
FIGS. 2 and 3, respectively, are cross-sectional views taken along lines 2—2 and 3—3, respectively, of FIG. 1, with some additional parts shown in FIG. 3.
Figure 3:
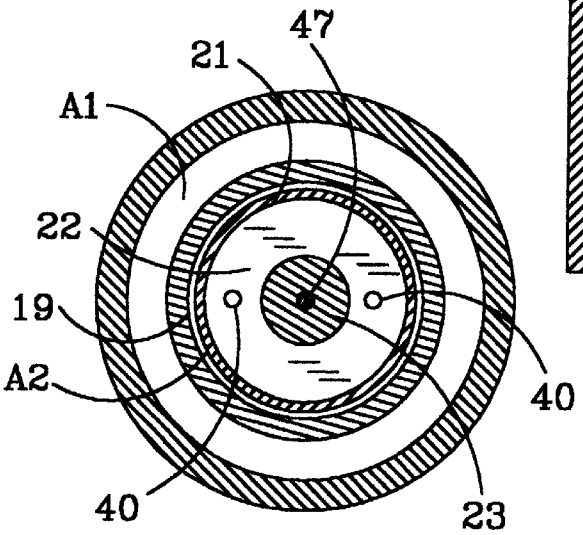

FIG. 1 illustrates one arrangement of the present invention 10 installed respective to a wellbore that previously was operated by a prior art pumpjack unit (not shown) which has been removed along with its downhole pump and sucker rod string. The borehole extends from wellhead H, down though a hydrocarbon producing formation F that forces formation fluid to flow through the casing perforations P into well casing annulus A1. The oil bearing formation F can also be referred to as the pay zone.

Figure 4:
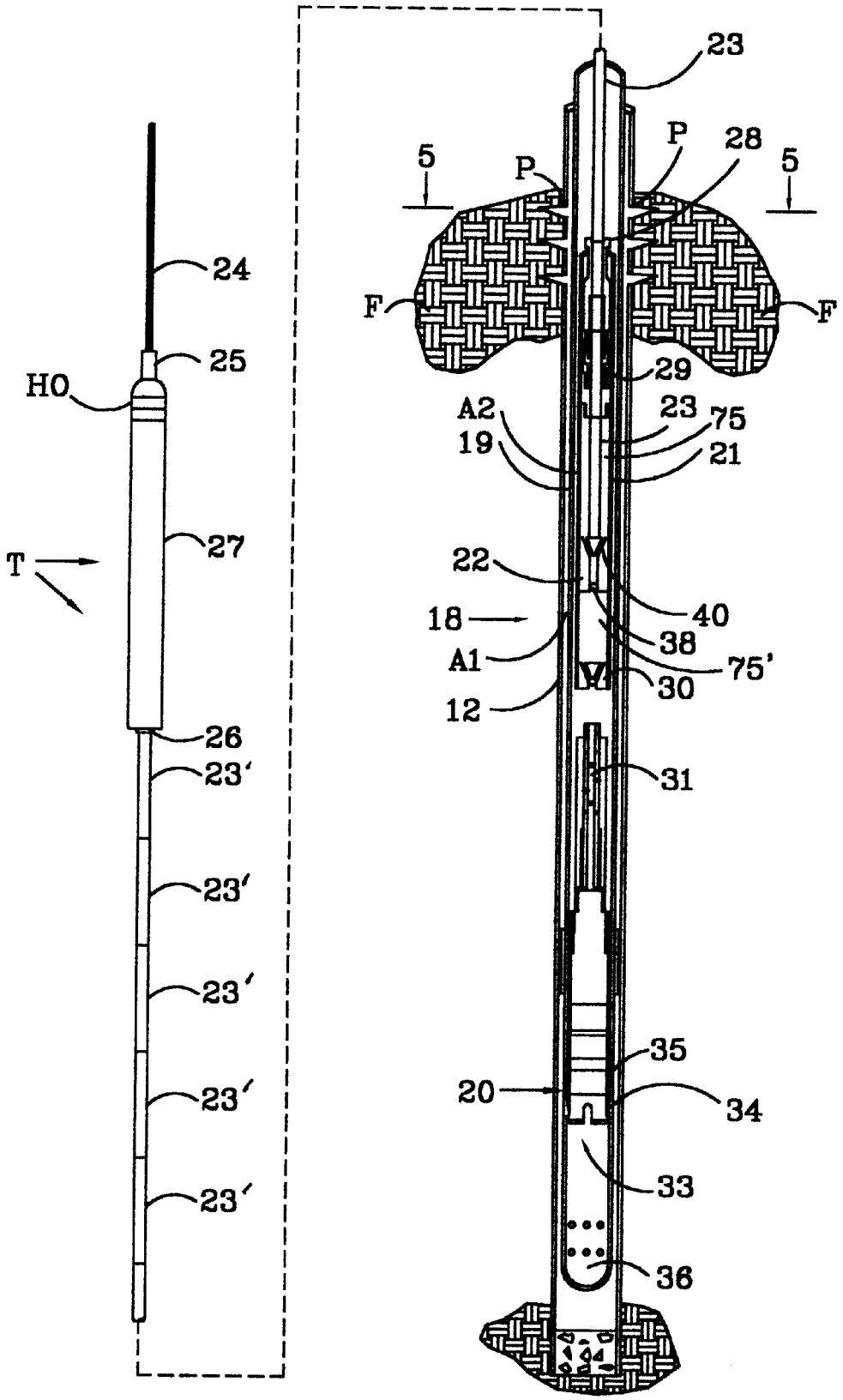
FIG. 4 is an enlarged, fragmentary, part schematical, part cross-sectional side view showing part of FIG. 1 in greater detail, with some additional parts shown in FIG. 3.

The subsurface apparatus 16 of FIGS. 1 and 4 includes a pump assembly 18, the details of which are more fully described in conjunction with other Figures of the drawings. The pump assembly 18 is telescopingly received in a slidable manner within the illustrated production tubing string 19, where it is releasably bottom supported by a prior art pump anchor apparatus 20, also referred to as a pump anchor and seating apparatus as disclosed in FIG. 1 at 32, 34; the details of which are known in the oil patch.

In accordance with the present invention, and as seen in FIGS. 1 and 4, together with other Figures of the drawings, the novel pump assembly 18 includes a very long pump barrel 21 made up from a plurality of individual lengths to facilitate assembly into a long continuous barrel. Within barrel 21 there is reciprocatingly received a plunger 22 connected to a polish rod 23, with the rod 23 being positioned to move axially upon being reciprocated by an elongate driving member, such as for example, a cable 24 that extends uphole to the surface apparatus 14. The polish rod 23 is also made into a plurality of connected lengths 23' having a small conductor passageway 47 (FIG. 5) therethrough as will be more fully appreciated later on. These assembled parts that are connected to and supported by cable 24 will hereinafter occasionally be referred to as a tool string T.

Figure 5:
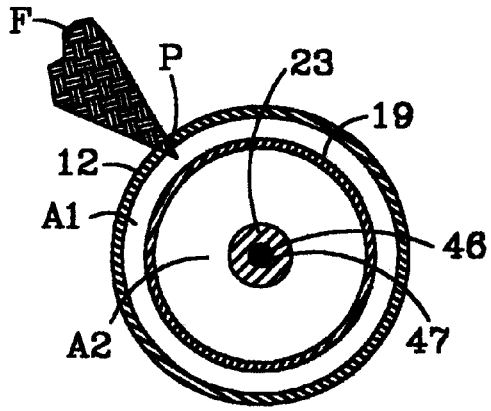
FIG. 5 is a cross sectional view taken along line 5—5 of FIG. 4.
Figure 8:
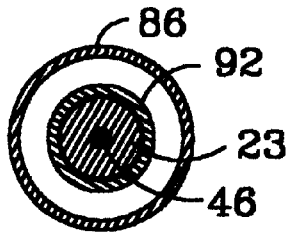
FIGS. 8 and 9, respectively, are cross-sectional views taken along lines 8—8 and 9—9, respectively, of FIG. 7; and discloses additional details of part of the apparatus thereof.
Figure 9:
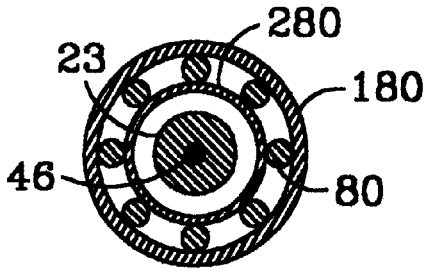
Figure 6:
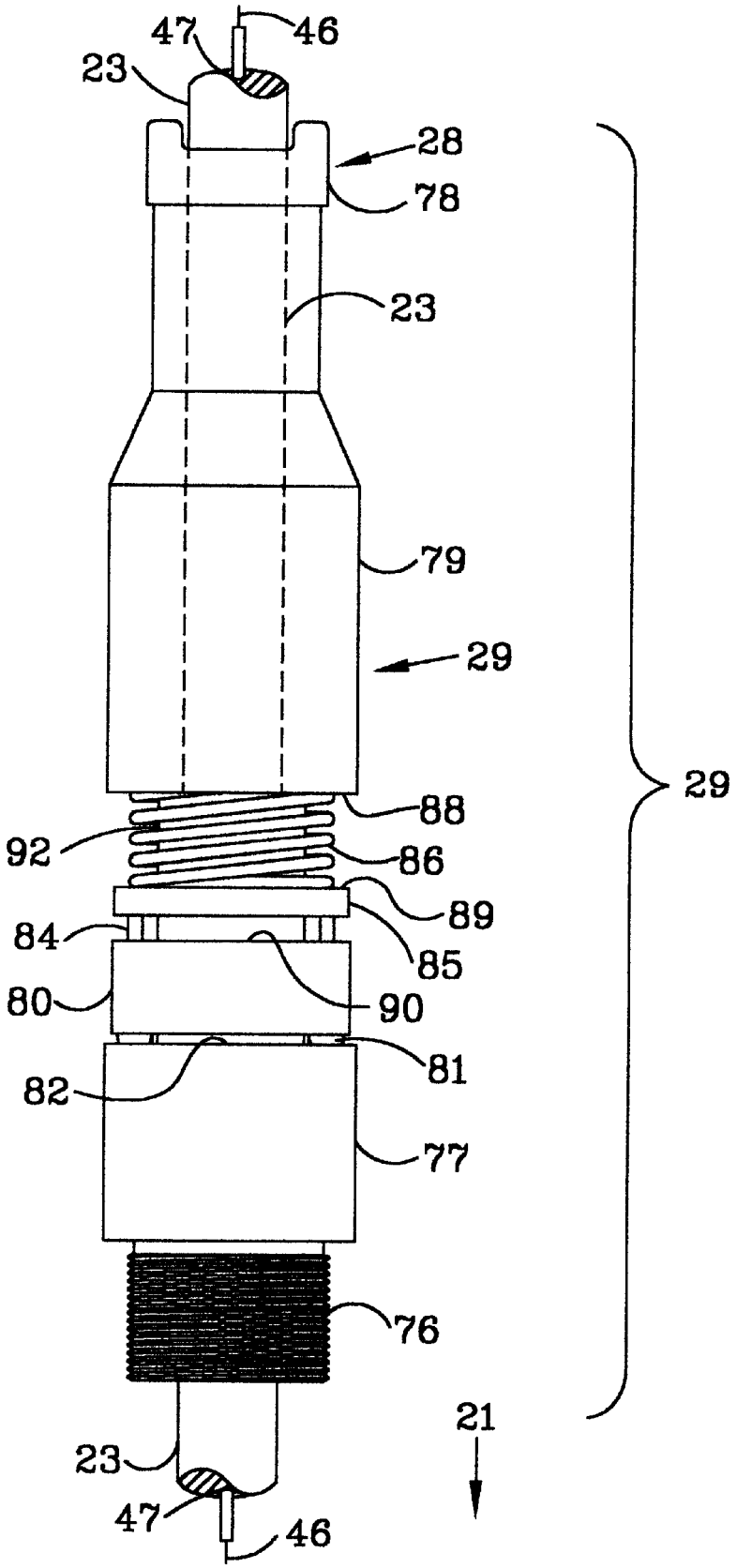
FIG. 6 is an enlarged side elevational view that sets forth additional details of an upper standing valve apparatus that forms a part of the invention disclosed in FIGS. 1 and 4; with some parts thereof being broken away and the remaining part shown in cross-section.

The entire tool string T, commencing with the cable 24 above wellhead H, includes a cable socket 25 suitably secured to the upper end 26 of the polish rod 23; or, as seen in FIGS. 4 and 5, a sinker bar 27 can be included between cable socket 25 and polish rod 23, as may be required. The polish rod 23 extends downhole through a guide bushing 28 located above a diagrammatically illustrated novel upper standing head valve assembly 29, made in accordance with the present invention, the details of which will be more fully discussed later on herein in conjunction with FIGS. 6–10 of the drawings. The upper standing head valve assembly 29 is the subject matter of co-pending U.S. patent application, Ser. No. 60/220,361, Filed on Jul. 24, 2000, Entitled: "RECIPROCATING PUMP STANDING HEAD VALVE".

Figure 11:
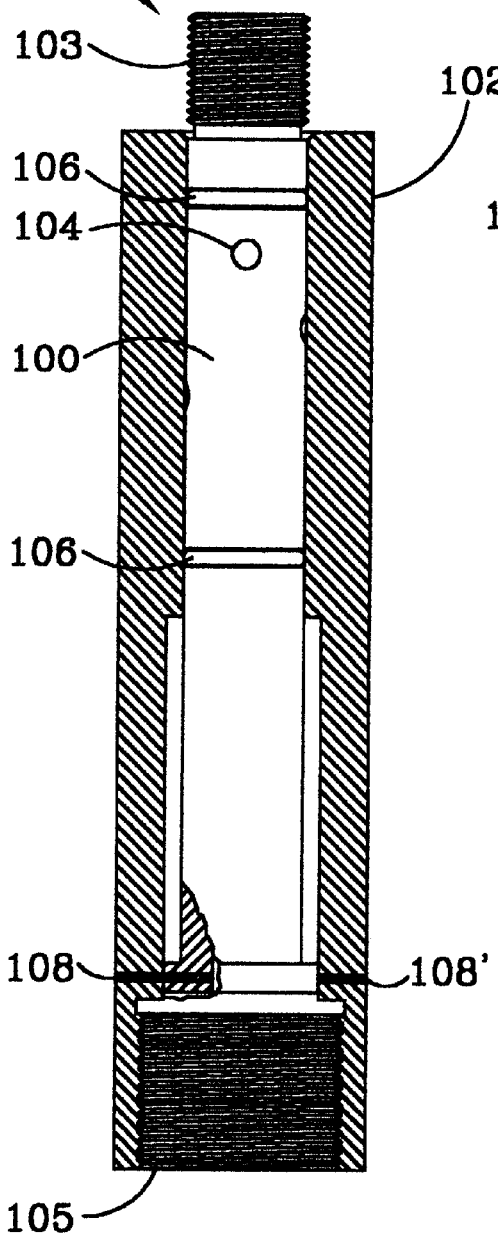
FIG. 11 is a longitudinal part cross-sectional side view that sets forth a bypass valve that forms a part of the apparatus of the foregoing FIGS. 1 and 4, and is disclosed in the normal or closed position of operation, with some parts thereof being broken away therefrom to disclose additional details.
Figure 12:
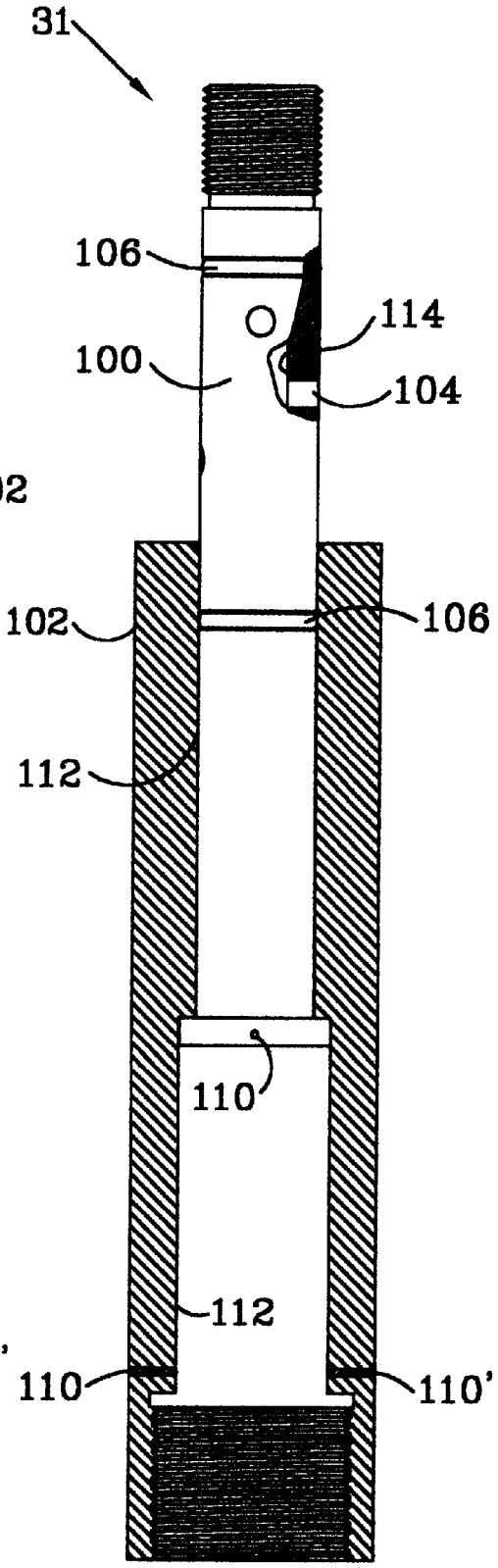
FIG. 12 is a longitudinal, part cross-sectional side view that discloses the apparatus seen in FIG. 11 in the open or alternate position of operation.

The upper standing valve assembly 29, as more fully disclosed in FIGS. 6–10, is connected at the upper extremity of. pump barrel 21 immediately below the guide bushing 28. The guide bushing 28 connects the pump assembly 18 to production tubing string 19, and forms the upper marginal end of the pump assembly 18. The lower end of polish rod 23 is connected to the upper end of a reciprocating traveling plunger 22. A lower standing valve 30 is affixed to the lower end of pump barrel 21. A bypass relief valve 31, the details of which are more fully set forth later on in conjunction with FIGS. 11 and 12, is connected between the upper end of the pump anchor device 32 and the lower standing valve 30. There usually will be another anchor device (not shown), often referred to as a tubing anchor device, located to anchor the lower end of the tubing string 19 to the casing 12.

As seen in FIGS. 1, 4, 11 and 12, the bypass relief valve 31, when actuated from the closed or normal operating position of FIGS. 1, 4 and 11 into the open or actuated position of FIG. 12, communicates tubing annulus A2 (FIGS. 1 and 4) respective the lower end 34 of pump anchor device 32. Lower end 32 will hereinafter also be referred to as the pump suction 33. Thus, the pump anchor and seating apparatus 20 includes a pump hold down device 32 having inlet end 34 telescopingly received within a seating nipple 35 (FIGS. 1 and 4). The pump anchor device 32 forms the lowermost end 34 of the tool string and is received within and sealingly engages the seating nipple or collar 35 in a releasable manner. The lower end of collar 35 is connected above a perforated joint 36, also called a sand screen, or a bull plug, or the like and is attached to the end of tubing string 19.

Figure 13:
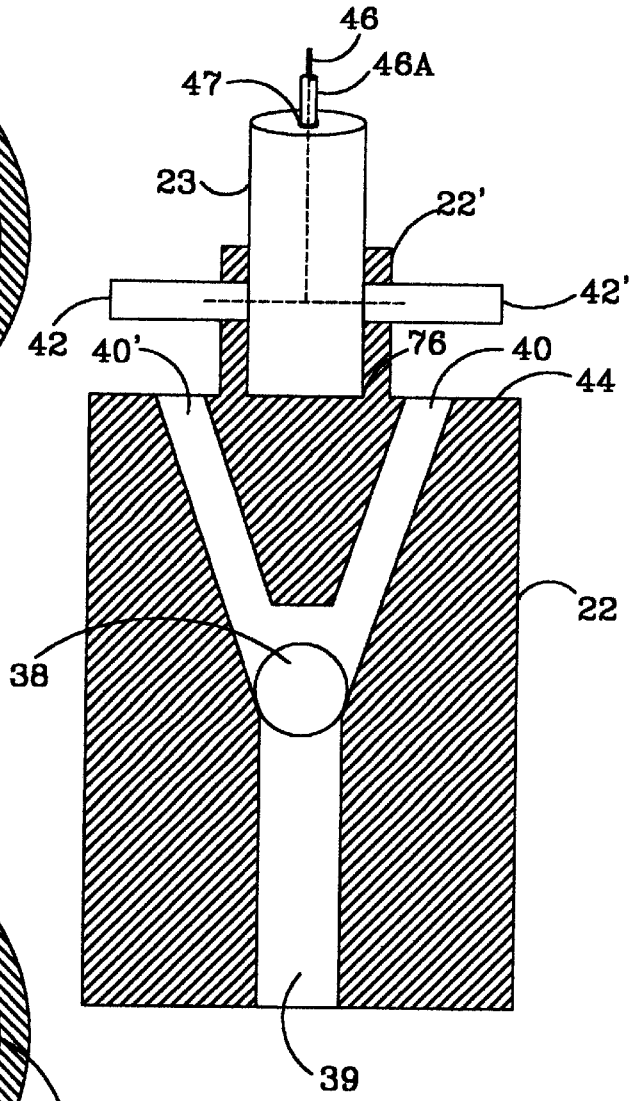
FIG. 13 is an enlarged, part schematical, part cross-sectional view of the plunger apparatus of FIGS. 1 and 4, showing additional details thereof.

The plunger 22, as shown in FIGS. 1 and 4, and in particular, FIG. 13, includes a traveling check valve 38 having a ball element suitably enclosed within a cage, the lower end of which forms the inlet passageway 39 into the plunger. The traveling check valve 38 is in the form of a one-way check valve by which fluid can flow only uphole through the illustrated passageways 40, 40' during the downstroke. A plurality of radially spaced circumferentially arranged sensors 42, 42', which can take on several different forms, are mounted in a protected manner on the plunger boss 22' adjacent the face of plunger 22 and form part of the plunger. The sensors protrude a small distance from the upper face 44 to easily sense the temperature, pressure, and conductivity of any fluid it contacts, thereby providing signals that are related to this data to the surface as will be more fully appreciated later on herein. Miniaturized circuitry forming a multiplexor device (not shown) connecting sensors 42, 42' to the insulated conductor 46 can be included if desired in order to facilitate conducting several signals along a single conductor that includes a grounded return path.

Still looking at FIG. 13, together with other figures of the drawings, conductor 46 extends from the sensors, uphole from proximity of plunger 22, and through the illustrated small passageway 47 formed longitudinally along the central axis of the polish rod 23. The insulated conductor 46 continues up the central axis of the sinker bars, to an interior conductor of cable 24, and terminates in proximity of cable drum 48 where provision is made for conductor 46 to transfer signals to computer 66 of FIGS. 14 and 15.

In FIGS. 1 and 4, together with other Figures of the drawings, it should be noted that hydrocarbon producing formation F drives fluid through casing perforations P into casing annulus A1, where the fluid flows downhole in order for the fluid to enter perforated joint 36. The fluid then flows uphole though the hold-down 34, axially through bypass relief valve 31, the lower standing valve 30, and into the variable or suction chamber 75' formed below plunger 22 that is located above valve 30 within the lower end of the pump barrel. The pump suction should be located at any reasonable elevation respective to casing perforations P, but preferably is positioned close thereto, as may be required to maintain an appropriate minimum fluid level or low hydrostatic head within casing annulus A1 so as to assure that fluid will follow the slowly moving plunger as it reciprocates on the upstroke and thereby substantially completely fills the exceedingly long pump barrel 21 with formation fluid. The term "fluid" is intended to include compressible and non-compressible fluids such as gas, crude oil, and water, for example.

Figure 14:
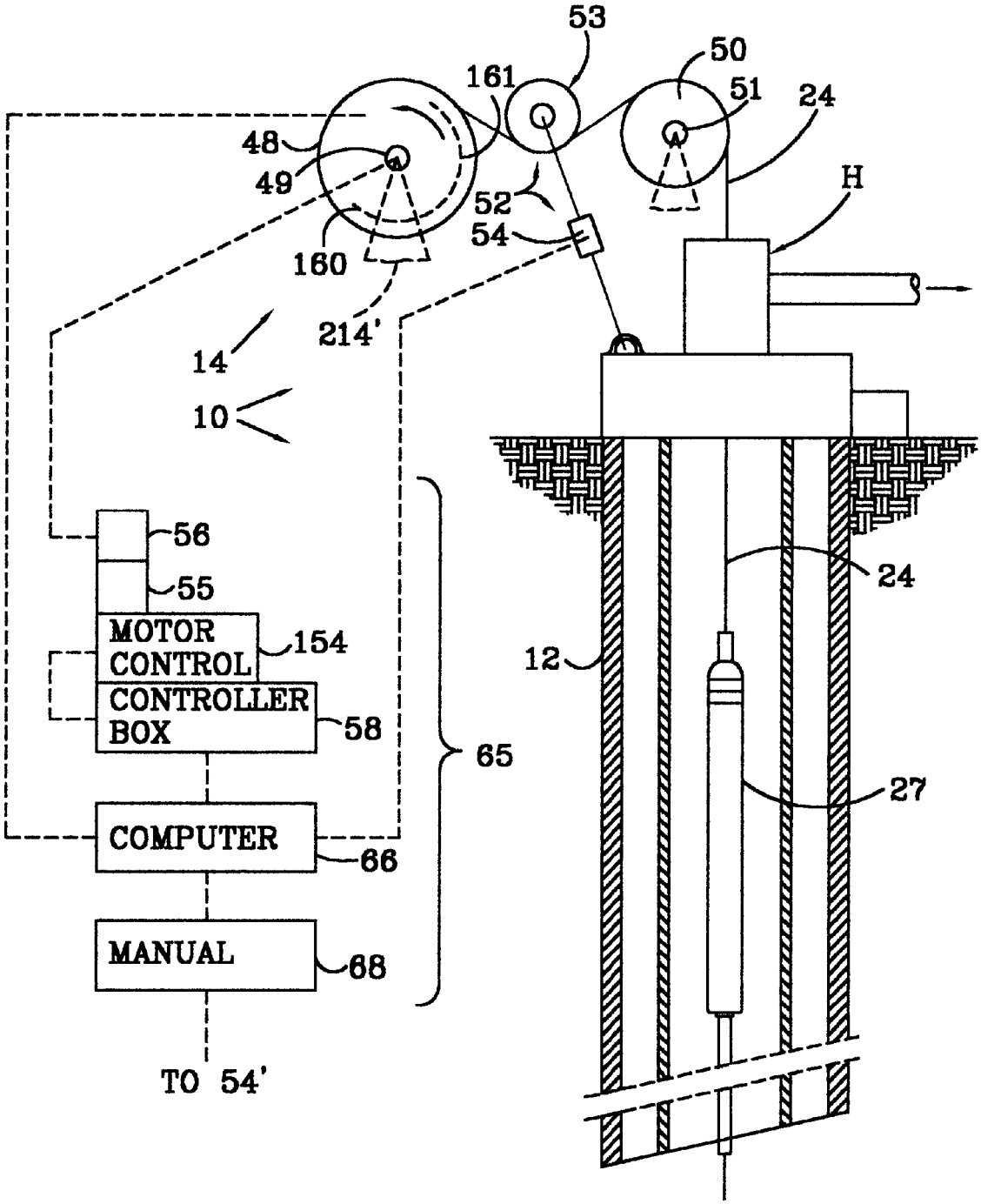
FIG. 14 is a schematical representation of a flow sheet showing one embodiment of an operating and control apparatus for the pump system of this invention.
Figure 17:
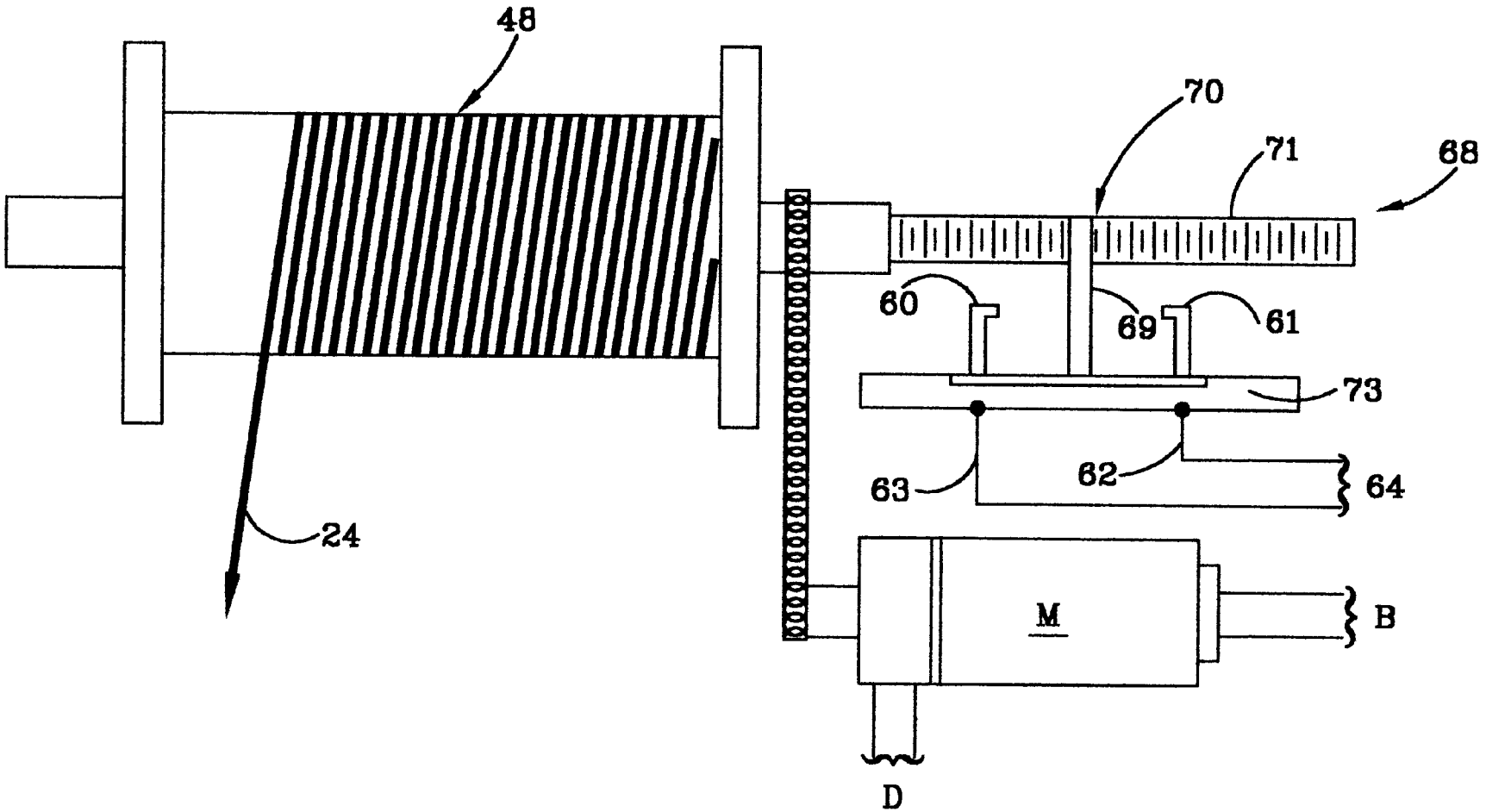
FIG. 17 is a schematical representation of a part of the hydraulic or electric control system that forms part of the production system of this invention.

Looking again now to the details set forth in FIGS. 1, 14 and 17 of the drawings, the surface apparatus 14 includes means by which an elongate member, cable 24 for example, can be controllably, moved in both directions to raise and lower plunger 22. One device for effecting this motion is a rotatable cable receiving drum 48 for reeling in and out the elongate member 24 disclosed as a relatively flexible cable 24 roved about cable drum 48. Cable drum 48 is spaced a suitable distance from a cable idler pulley 50 having axis 51 thereof located to position the cable 24 axially above the wellhead H. Thus, a length of cable 24 is arranged along the central longitudinal axis of the tubing string 19 of borehole casing 12.

In FIG. 14, a weight sensor and indicator apparatus 52 is illustrated as having idyler pulley 53 connected to apply a force against the tension of operating cable 24 thereby continuously weighing the entire string of tools attached to the lower end of cable 24, along with any well fluid within the pump barrel being lifted. The weight sensor apparatus 52 and indicator 54, which can take on any number of different known forms, are connected to provide a proportional weight signal to computer 66. The signal from transducer 54 can also be connected to appropriate circuitry 56 which in turn is connected to motor control 154 so that a cable drum motor can be speed controlled responsive to cable tension as more fully described later on herein. Numeral 55 is apparatus responsive to plunger position that is connected for controlling the stroke range of plunger travel.

The weight sensor apparatus is connected between axis 51 of cable idler pulley 50 and cable drum 48 in the illustrated manner of FIG. 14. The weight sensor can be anchored to the skid mounted apparatus 214, or any other suitable dead man such as seen illustrated in FIG. 14 at 214', such that there is provided a signal proportionately related to the weight of the downhole mass connected to the end of cable 24. Hence, the weight indicator measures the tension of the upper marginal terminal end of cable 24, thereby providing a means of constantly determining the instantaneous weight of downhole fluid contained above plunger 22 that is to be lifted by rotating cable drum 48.

FIGS. 14–17, disclose various embodiments of controller apparatus that energizes and controls the speed and direction of rotation of cable drum 48 to lift and lower plunger 22 of pump assembly 18 in order for the pump barrel 21 to be filled and made ready for the upstroke, and thereby controls the rate of production of the downhole pump.

In FIG. 17, for example, cable drum 48 is connected to operate a simplified form of control device 68 for use in controlling the cyclic operation of the plunger. Control device 68 employs spaced switch means 60, 61 that are connected electrically to relays 62, 63 to provide a signal at 64 which is connected to control box 58 and optionally to computer 66 of controller apparatus 65 of Figure 14. Computer 66 is programmed to carry out the before described pumping operation. The drum control device 68 includes a switch actuator device 69 that engages a threaded marginal length 71 extending along the longitudinal central axis of drum shaft 70. Device 69 oscillates along a track formed on support member 73 in response to movement induced by device 69 threadedly engaging the threaded marginal shaft length 71 to alternately contact and actuate one of the pair of switch means 60, 61 as device 69 moves in opposed directions along the threaded shaft. This action alternately actuates switches 60, 61 to change direction of rotation of cable drum 48. Accordingly, this action of control device 68 determines the length of the stroke of pump assembly 18 while rotational speed of the shaft determines the time interval of the upstroke and downstroke of plunger 22.

Alternatively, as seen in FIG. 14, the position of pump plunger 22, also disclosed in FIGS. 1 and 4, can be determined electronically by a signal producing means attached to the drum as indicated by numerals 160, 161 wherein a series of circumferentially spaced magnetic signal producing means 160 trigger or send signals related to inches of cable travel while another signal producing means 161 sends a different signal related to feet of cable travel, for example.

Looking now to the details of the pump assembly 18 set forth in FIGS. 1 and 4, the valve assemblies 29, 30 and 38, are spaced apart along the central axis of pump barrel 21 and polish rod 23. The standing valve assemblies 29 and 30 form a variable production chamber of any desired length therebetween. The upper or standing head check valve assembly 29 supports the fluid column located in the tubing string above pump assembly 18 during the downstroke, and opens on the upstroke while the traveling check valve 38 (FIG. 13) is closed while lifting or displacing fluid from the variable production chamber 75 of the barrel as the pump plunger is stroked uphole in response to the action of surface equipment 14. The lower standing valve 30 can be a ball check valve which permits flow only in an uphole direction and therefore must leave its seat each up-stroke of plunger 22, and is closed against its seat on each downstroke of plunger 22.

As best seen in FIGS. 1, 4 and in particular, FIG. 13, an axial passageway 47 formed through the polish rod receives the illustrated conductor 46, 46' therein for transmitting downhole data signals uphole to the computer 66 in FIG. 14. One of the opposed ends of the conductor is connected to the plurality of radially disposed sensors 42, 42' located adjacent the upper face 44 of plunger 22 to provide signals to computer 66 of surface apparatus 14. The conductor extends from the sensors, axially up through the small axial passageway 47 formed in polish rod 23, axially through sinker bar 27 and cable 24, where it provides selected signals that are available at terminal 49 on cable drum 48, for example. Terminal 49 can be a slip ring contacting means or the like. The signal, when processed by computer 66 connected to controller 65, instructs controller 58 the next appropriate step to be taken at this time. As best seen in FIG. 4, between the plunger 22 and upper standing valve assembly 29 there is formed the before mentioned variable production chamber 75 of any desired length.

FIGS. 6–10 set forth specific details of the check valve assembly 29, having a lower threaded pin end 76 formed on lower annular sub 77 opposed to a threaded box end 78 formed within annular upper sub 79 which forms the guide bushing 28 by which valve assembly 29 is connected into the tool string. Valve assembly 29 supports the fluid column located in the tubing string 19 above pump assembly 18 during the plunger downstroke, thereby removing the tubing hydrostatic head which otherwise is placed on the plunger during its downstroke.

Upper standing valve 29 has a ball cage 80 located between subs 77 and 79. Ball cage 80 has radially spaced holes 180 within which balls 81 are captured in radially spaced relationship such that each ball can be moved uphole a limited distance within its hole relative to its seat. The ball seats are formed within the upper face 82 of member 77 as seen illustrated in FIG. 7. The radially spaced balls 81 are individually attached to one end of pins 84 with the opposed ends thereof being attached to annular pin holder 85. Spring 86 is compressed between lower face 88 of sub 79 and upper face 89 of pin holder 85 to urge the balls onto the seats formed in the upper face 82 of sub 77. Passageway 90 is formed axially through valve 29 and guide bushing 28, and is of an inside diameter to sealingly and reciprocatingly receive the polish rod 23 therethrough.

Figure 7:
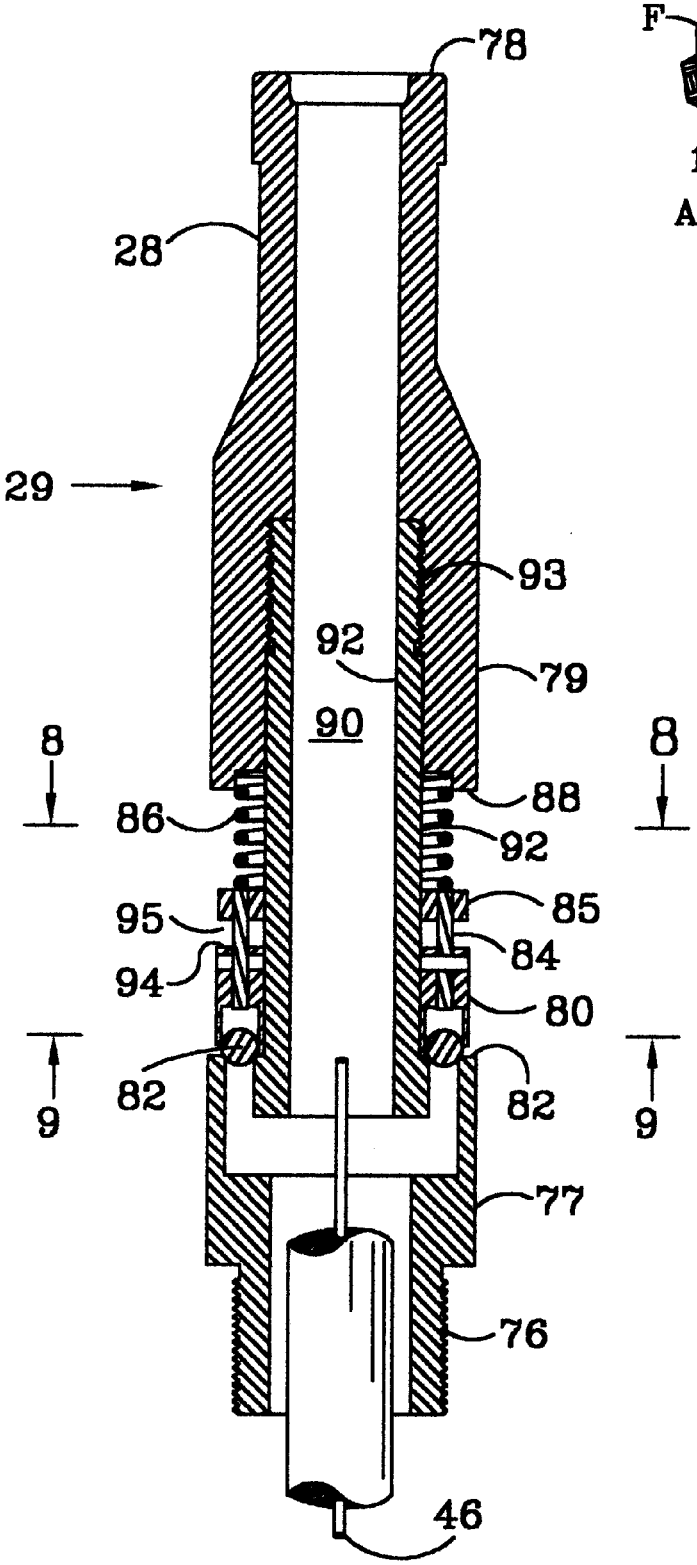
FIG. 7 is a longitudinal cross-sectional view of the apparatus of FIG. 6 and disclosed in the normal or closed position of operation.
Figure 10:
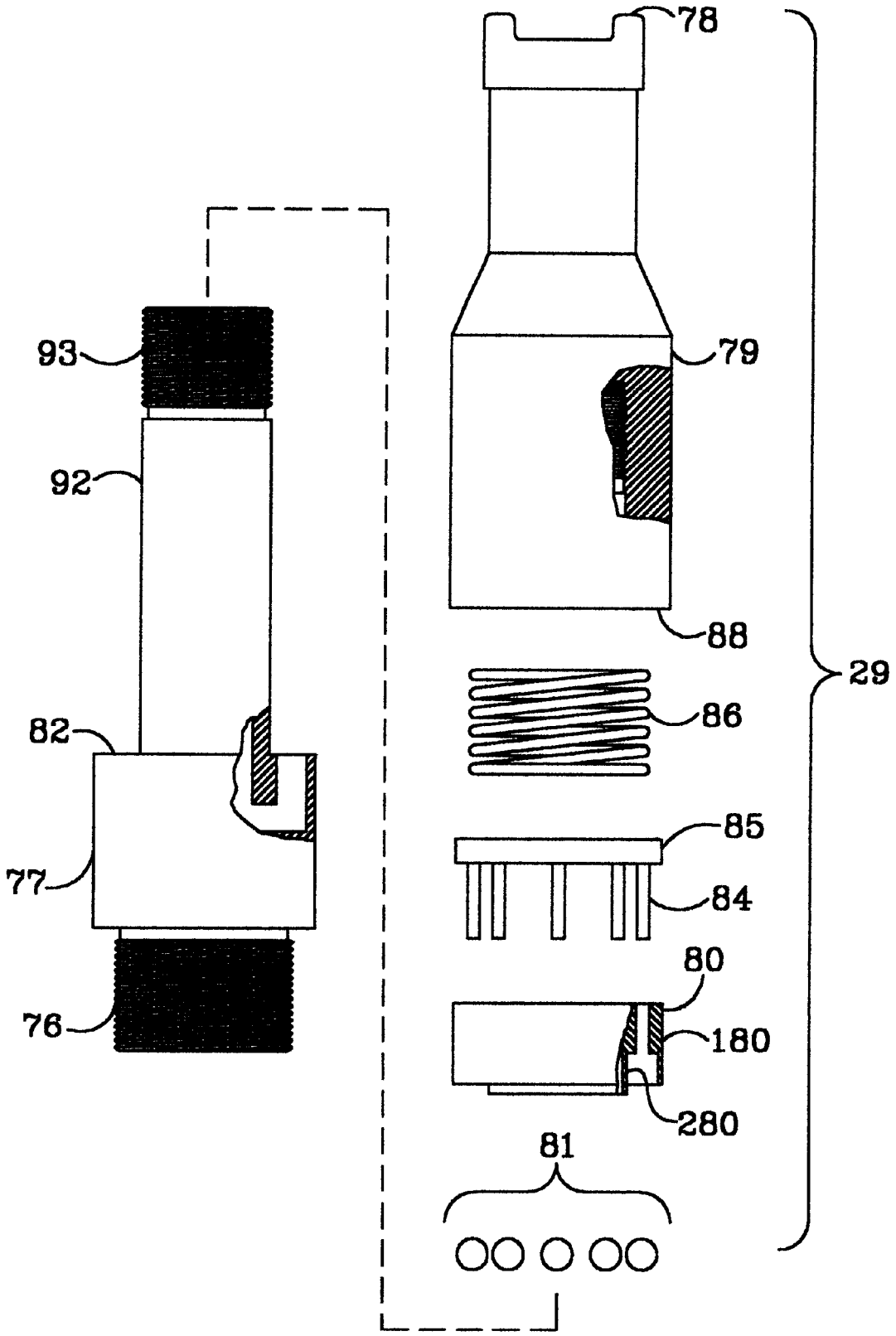
FIG. 10 is an exploded view of FIG. 6.

As best seen in FIGS. 7 and 10, sub 77 has integral extension 92 upwardly depending therefrom and threadedly engaging co-acting threaded surface 93 formed on a marginal interior length of guide bushing 28. Upon assembly, it will be noted that the tool is spaced out such that there is a space 95 formed above member 94 and below the lower face of member 85 to assure proper seating and opening of the valve apparatus.

The upper standing stationary head valve 29, lower standing valve 30, and traveling check valve 38 should be trouble free and provide many months of efficient operation. The system will lift about 4 gallons each stroke per 100 foot length of pump barrel of a size to fit within a standard 2 inch diameter oil field production tubing.

Contrasted to the usual production system, this invention produces the well at its maximum output for 24 hours each day, in order to always keep the hydrostatic head at perforations P to a minimum. After completion of a relatively slow upstroke of plunger 22, the cable drum is energized to rotate in an opposed direction wherein there is a delay, or a time of no flow for a short time while pump plunger 22 descends on its down stroke. This downtime, together with the upstroke time, is representative of the total lapsed time required to keep the hydrostatic head at the perforations P at a minimum. This short delay or downtime of the downstroke is considered part of the production cycle and accordingly does not interrupt the continuous production of the well, but only interrupts the sequential outflows at wellhead H as the plunger descends through the fluid column in the lower chamber of the barrel. The downstroke forces the plunger to pass through the fluid contained in the lower barrel chamber as the plunger comes to rest momentarily at the bottom of its downstroke so that the fluid now is contained above the plunger, ready to be lifted by the plunger. The cable drum is again energized to rotate in the opposite direction and slowly lifts the plunger. During this upstroke time, while the displaced production fluid flows from the well head H, well fluid is being sucked into the lower barrel chamber, following the plunger uphole which results in a full barrel of fluid when the plunger reaches the end of its upstroke.

The cable tension is measured by weight indicator apparatus 52 (FIG. 14) and 52' (FIG. 1) during each pumping cycle. The cable tension, for example, may commence at 600 pounds tension, which represents the weight of the tool string when the plunger is at rest at the end of the downstroke.

In order to ascertain the quantity of produced fluid contained within the barrel, one method advantageously used is for the cable drum to pull in a minimum length of cable as required to weigh the fluid contained within the barrel without significantly up stroking the plunger. This action may increase the cable tension to a value of 900, which represents the 300 pounds of fluid transferred into the barrel (900 pounds total weight less 600 pounds cable tension equals 300 pounds produced fluid).

After the downstroke of the plunger the cable is tensioned due to the plunger lifting the fluid contained in the barrel. This action compresses the gas located at the top of the barrel to a value equal to the hydrostatic head in the tubing string. Additionally, as the upper stationary valve opens to admit fluid therethrough and into the tubing string, an additional tension is imposed on the cable due to overcoming the spring loaded valve parts. Hence, the slow upstroking plunger forces fluid contained within the upper working chamber of the barrel to be transferred into the tubing string and at the same time a like amount is discharged at wellhead H. This amount of fluid represents the amount of produced fluid for one pumping cycle of system 10.

After the difference in tension due to the spring force on the upper standing valve has been applied to the cable, there is a constant tension as the plunger continues its upstroke. The cable drum stops the plunger at the end the upstroke, then reverses rotation, which downstrokes the plunger during a selected time interval as the plunger descends through the fluid trapped in the barrel by the lower standing valve 30 during the previous upstroke.

Many wells produce flour sand as well as corrosive materials which can cause a pump barrel to become stuck inside the tubing. Should this happen it is necessary to move the barrel upward with cable tension just a fraction of an inch to open the bypass tool of FIGS. 11 and 12 which can allow fluid to bypass and remove the unwanted material which has caused the barrel to become stuck. The bypass valve of FIGS. 11 and 12 is used if the anchor device 32 failed to release from its seat 35.

A short extension of the barrel 21 is located below the lower standing valve 30 and includes a bypass relief valve 31 having a mandrel 100 which is slidably actuated in a telescoping manner respective to a sleeve 102 when the mandrel 100 is lifted uphole respective to the sleeve 102. The bypass valve has a pin end 103 at the top thereof attached to the lower end of barrel 21, and a box end 105 at the bottom thereof connected to the pump hold down. As seen in FIGS. 11 and 12, sleeve 102 is of annular configuration and covers equalizer ports 104 formed through the sidewall of mandrel 100. The mandrel 100 is arranged to be slidably moved uphole and into the open position in order to uncover equalizer ports 104 and thereby equalize pressure between the suction at 33 of the pump assembly and the adjacent tubing string annulus A2.

Spaced seals 106, 106' are installed on mandrel 100 and cooperate with sleeve 102 for preventing flow of fluid through equalizer ports 104 when the ports are covered by sleeve 102. The seals 106, 106' can be placed on the inner wall surface 112 of the sleeve rather than on the outer wall surface of the mandrel as shown. The mandrel has a central axial passageway 114 extending therethrough.

Shear pins 108, 108' prevent relative movement between the pump barrel and the sleeve when the bypass is in the closed position as set forth in FIG. 11. The shear pins 108, 108', which hold the bypass in the closed position are designed to shear at a pull considerably more than is required to unlatch the anchor device 32, 35. As seen in FIG. 12, the shear pins 110, 110' have been sheared, as a result of relative movement between the mandrel and the sleeve by elevating the pump barrel, since the sleeve is anchored by the hold down. This action uncovers equalizer ports 104 and allows flow of fluid from the tubing through the uncovered ports and into the lower end of the pump assembly near the suction, thereby equalizing the pressure therebetween. This action of the mandrel respective to the sleeve shears the pins 108, 108' as the bypass is moved from the closed position of FIG. 13 into the open position of FIG. 14 by lifting the barrel. The barrel is lifted by engagement of the plunger respective the lower face of upper standing valve assembly seen at 29. Uphole opening slidable movement of the mandrel 100 is achieved by upstroking the plunger into contact with the lower face of the upper standing valve with sufficient force to shear pins 108, 108' and move the bypass relief valve 31 from the closed position of FIG. 11 into the open position of FIG. 12, which illustrates the apparatus in each of these configurations.

In FIG. 1 of the drawings the tension in the operating cable 24 is measured by weight indicator or tensiometer 52 connected to continually weigh pulley 50 at the axis 51 thereof. The tensiometer 52 provides weight data of everything connected to the downhole end of the cable 24 This data is relied upon by oil field production Engineers to ascertain a number of different downhole variable conditions, especially when going into and coming out of the bore-hole with a string of tools. Data from tensiometer 52 is in the form of a signal that can be accessed at junction 52', where the signal can be processed by circuitry (not shown) to provide most any form of conversion, as for example, pounds.

A pulley 222 (FIG. 1) is positioned to be rotated by longitudinal movement of cable 24 when the downhole pump plunger is reciprocated. Rotation of pulley 222 generates a signal that can be interfaced or connected to depthometer 220 seen in FIG. 15. The depthometer 220 has the necessary means to provide a suitable display at 220 that indicates the depth of the plunger in the borehole casing 12. The depthometer 220 is also connected to the illustrated bottom setting device 224 and top setting device 226 for setting the stroke length of plunger 22. Device 220 also connects to the meter reading up display device 228 and meter reading down device 228', each of which is related to the previously selected operating range of plunger 22 as the uphole end of cable 24 is roved onto and away from winch drum 48 in order to reciprocate the downhole pump plunger 22.

Figure 15:
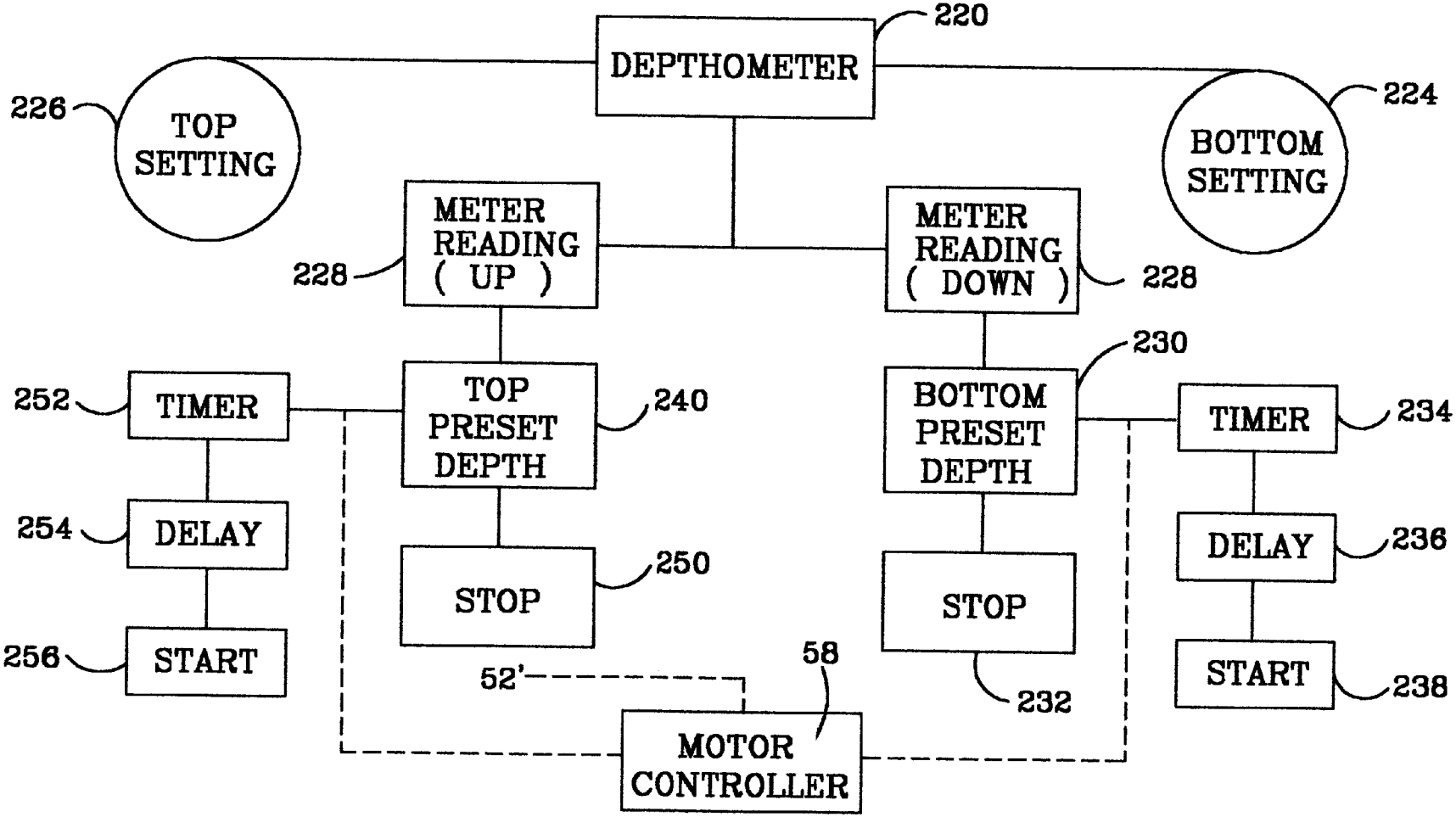
FIG. 15 is a schematical representation showing another embodiment of an operating and control apparatus for the pump system of this invention.

Still looking at the control apparatus of FIG. 15, the operating range of plunger 22 is selected and set by entering data in the bottom setting device 224 for selecting the low end of a selected plunger operating range; and, entering data in the top setting device 226 for selecting the high end of the selected plunger operating range; with the difference therebetween representing the operating range of the reciprocating plunger, preferably displayed in feet. The depthometer device 220 signal is also connected to the meter reading down display 228' and to the meter reading up display 228. The meter reading up display provides data related to the instantaneous location of plunger 22 while the plunger is traveling upwards on the upstroke. The meter reading down display provides data related to the instantaneous location of plunger 22 while traveling downwards on the downstroke. Hence the active meter reading device is an indication of the direction of plunger travel as well as plunger location.

The meter reading down display device 228' is connected to the bottom preset depth device 230 which in turn is connected to both the stop device 232 and to the timer device 234. The timer device 234 is connected to delay device 236 which in turn is connected to the start device 238.

The meter reading up device 228, in a manner similar to the before described meter reading down device 228', is connected to the top preset depth device 240 which in turn is connected to both the stop device 250 and the timer device 252. The timer device 252 is connected to delay device 254 which in turn is connected to the start device 256. The above signals also can be connected to computer 66 of FIG. 14 to control any of the previously recited operating parameters of the well, such as the illustrated motor controller 58.

As an illustrative example only, assuming a pump barrel 21 is 100 feet in length and the apparatus of FIG. 15 is programmed with the bottom setting device 224 reading 2690 feet, which is the depth to which plunger 22 desends, the bottom of the barrel actually will be at 2695 feet, for example, which provides an ample clearance for operation of five feet between the upper face of the lower standing valve 30 and bottom face of plunger 22.

With the top setting device 226 set for the depth of plunger 22 at 2600 feet, the lower face of the upper standing valve 28 will be at 2595 feet, which at the end of the upstroke provides five feet clearance between the top of plunger 22 and the bottom face of the upper standing valve 28.

When the depthometer device 220 reads 2690 feet, which places the plunger 22 on the bottom of its stroke, the motor will stop and the brake will set, while at the same value, a delay at device 254 is set and commences to time out while the motor is reversed. When the delay time device 252 is up, the brake is released as the motor is started to lift the plunger at whatever speed is set with the gear box. When the plunger reaches 2600 feet, the motor will stop and the brake will set while a delay device 252 takes over. After the delay timer 234 times out, the brake is released and the motor is energized in the reversed direction by the start device 238. This action lowers plunger 22 at a preset speed and the motor will stop when the plunger reaches 2690 feet. The forgoing describes one complete cycle of operation, that is, an upstroke followed by a downstroke. This method of operation is repeated continuously, 24 hours/day, producing the wellbore at its most optimum production rate until the well is shut in for some reason.

In FIG. 1 of the drawings, a limit switch is connected to terminal 52' of the weight indicator 52 for use in assuring that proper tension is kept in cable 24 at all times. The limit switch is connected to the system of FIG. 15 to stop the drum motor and set the brake should the weight indicator exceed a set range of values in either extremity. For example, on the downstroke should cable 34 tend to be over-run, the limit switch will activate the shutdown to stop the motor and set the brake. In a similar manner, on the upstroke, should the plunger become caught because of unforseen circumstances, the limit switch will activate the shut-down to stop the motor and set the brake. It is difficult to imagine any resultant damage to the system in view of the slow moving plunger 22 and the long relatively resilient cable 24.

FIG. 14 discloses another embodiment of the invention having a cable drum 48 rotatably mounted on support 214 and rotated by a variable speed hydraulic motor (not shown) of a known type having the capability of rotating at any selected speed within a designed range of speeds and connected to be part of an algorithm or computer program that is written by those skilled in the art to carry out suitable commands from computer 66 that is consistent with the operation taught and set forth in this disclosure.

Figure 16:
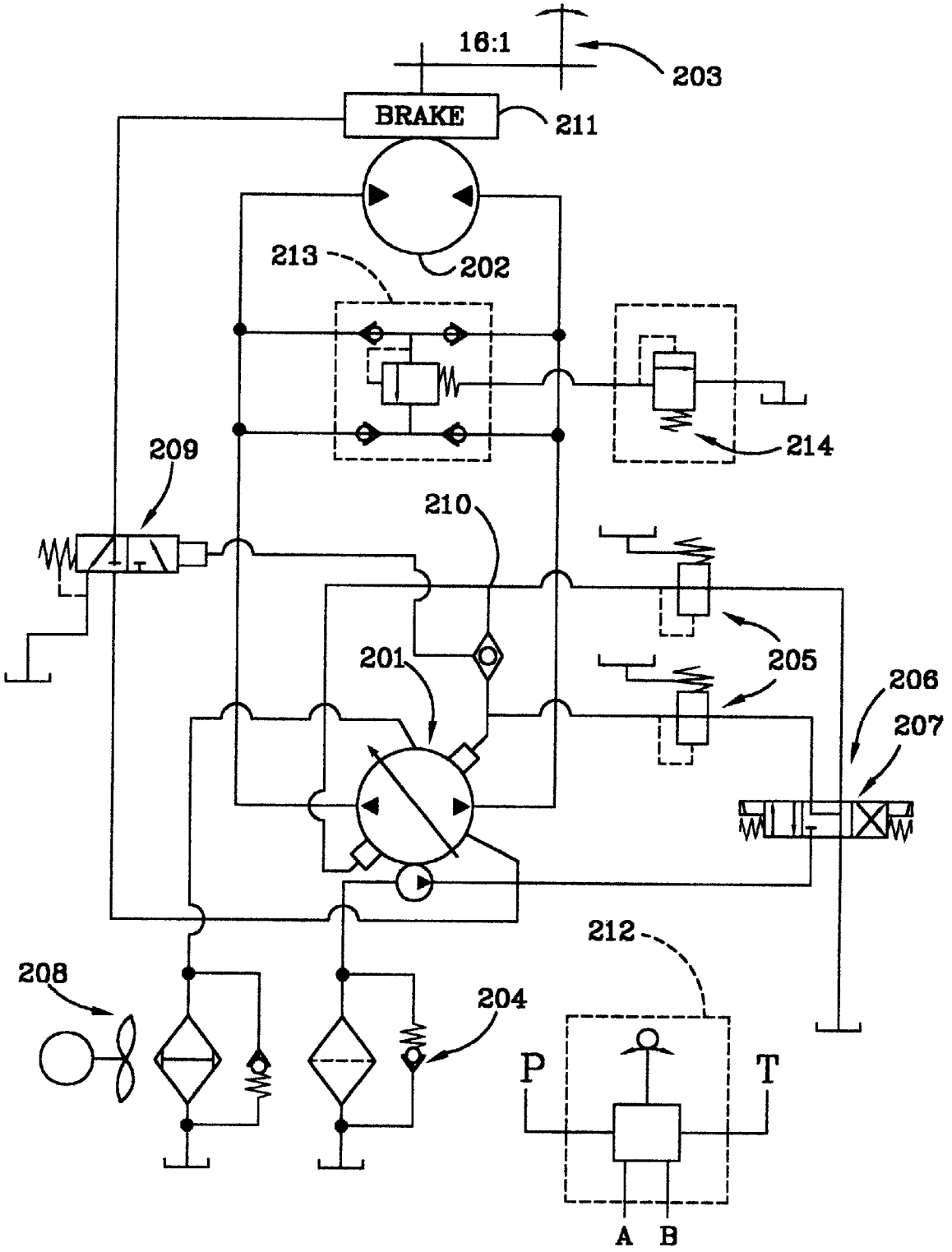
FIG. 16 is a schematical representation of a hydraulic control system that forms an alternate embodiment of the operating system for the pump system of this invention.

FIG. 16 is a schematical representation of one embodiment of the invention that illustrates another form of a control apparatus by which cable drum 48 can advantageously spool cable 24 in response to commands received from the programmed computer of FIGS. 14 and 15. In FIG. 16 the suction side of hydraulic pump 201 receives filtered fluid from device 204 which in turn is connected to the illustrated reservoir. The pressure side of the pump is connected to controllably provide power fluid to the hydraulic motor 202. The spent power fluid from the motor is returned through the radiator 208, the output of which is connected back to the reservoir.

The output shaft of motor M of FIG. 16 is connected to rotatably drive a reduction gear box 203 and thereby rotate cable drum 48 which spools cable 24 onto and away from cable drum 48. A hydraulically actuated brake assembly 211 is arranged to prevent rotation of the drum when the brake is actuated by hydraulic valve assembly 209. The valve assembly 209 also controls output from pump 201 so that there is no flow of power fluid to motor M when the brake is locked.

The four-way valve assembly illustrated at 206 and 207 of FIG. 16, controls the operation of the pump, and can be remotely operated. Pressure reducer 205 is connected to the four-way valve to unspool the cable when the four-way valve is in one position, and spools the cable when in another position of operation as well as controlling the action of the brake in response to pressure drop across the motor 202. A remote relief control valve 213 and 214 maintains the hydraulic pressure differential across motor M and thereby determines the speed at which the cable 24 is operated.

Also included is apparatus for startup only, which is in the form of a friction hold control valve 212 arranged to override the other hydraulic control valves by operating only the pump, motor, and cable drum brake.

While numerous different hydraulic components can be used in the hydraulic control system of FIG. 16, one source of suitable components is as follows:

201 pump: Ondiout & Pavesi
202 motor: White 10565270
203 gearbox: 502-NC-16:1/SAE A6V
204 filter: 30-8G2-A25A-VS
205 valve: pressure reducing 1-D-65-A-A-XXX
206 valve: 4-way 8S-001-06-RC115-100
207 valve sub plate for valve 206 above: 10101
208 oil cooler and motor
209 valve: ACP720-5-B-63-050
210 valve: ACP120-1-D-68
211 brake: MICO 034060640M
FOR START-UP ONLY:
212 remote hydraulic control, friction hold 99023
213 valve: remote controled relief
214 remote relief controller Those skilled in the art having studied the above parts list together with the schematical representation of FIG. 16 will appreciate that the downhole pump assembly is cyclically operated in the novel method described in conjunction with the various other figures of the drawings. The system of FIG. 16 is remotely controlled by the apparatus seen in FIGS. 15–17 to remain in standby configuration until the pumping operation is started, whereupon, assuming the pump barrel has been filled with fluid from the previous upstroke, the plunger is next upstroked in response to movement of an elongate member connected to stroke the pump rod. This action is achieved with apparatus such as the cable drum of FIGS. 1, 14, and 17, which is instructed by computer 66 to be rotated to reciprocate the pump plunger at a predetermined speed to slowly upstroke the pump plunger and thereafter, to unspool the cable at a second predetermined speed, bringing the plunger to rest momentarily at the bottom of the pump barrel, thus completing one cycle of operation during a time interval required for formation F to produce one full pump barrel of fluid. This cyclic operation continues until the well is shut down.

Accordingly, fluid is pumped to the surface at the same rate that fluid is produced from formation F. Hence, the time interval of one cycle of operation is based on the production history of the well in accordance with this invention. The stored data related to the production history of the well contained in computer 66 enables the computer to determine the quantity of fluid contained within the pump barrel each cycle of operation and to change the time interval for successive cycles of operation so as to continually adjust the time intervals to coincide with the rate of production of the formation F whereby the optimum rate of production is always attained by this method of operation of the apparatus disclosed herein. This cyclic operation continues until the well is shut down.

In FIG. 13 of the drawings, one of the plurality of sensors at 42, 42' measures pressure and thereby determines the hydrostatic pressure or fluid level within the barrel above the plunger. Another sensor 42, 42' measures conductivity to enable the fluid contents of the barrel to be ascertained as well as to determine the position of the water/oil interface within the pump barrel, and thereby provides data that can be used to control the time interval of the pump stroke, which enables an oil skimming process to properly function.

In FIG. 15, the meter reading up is a display of data related to a range of operation which is controlled by the preset depth and automatically stops lifting the cable uphole in order to accurately position the pump plunger respective the top of the pump barrel.

The timer of FIG. 15 controls the time interval during which the cable upstrokes the plunger, then the operation is delayed momentarily a sufficient length of time to enable the control system to reverse rotation of the drum and commence the downstroke part of the timed cycle.

The meter reading down of FIG. 15 is related to the position of the plunger to assure that it operates within a predetermined range as it down-strokes to a preset depth.

When the control system of FIG. 15 is used in conjunction with any of the disclosed cable actuating apparatus for stroking the plunger, the cycle of operation commences, for example, with the plunger properly positioned within the barrel at the end of the downstroke, wherein, the upper barrel chamber is full. A time delay provides an interval of time for the next cycle of operation. The preset depth assures that the plunger comes to rest at a location spaced above the lowermost end of the pump barrel. The meter reading down provides instantaneous data related to plunger position respective the pump barrel. The depthometer displays data related to the elevation of the plunger at all times.

In FIG. 15, the start control 256 determines when the upstroke part of the cycle of operation commences. The delay device 254 continuously adjusts the time interval of the upstroke to assure a sufficient time has passed for the lower barrel to be filled prior to starting the next downstroke. The preset depth 240 is the desired lower elevation that assures the plunger will clear the upper standing valve of the pump. The meter reading up 228 is the instantaneous data related to plunger location during the upstroke.

Stripper wells and gas wells of low production rates often load up with salt water which must be trucked to disposal and this can use up much of the profit the well might otherwise provide. It is not unusual to pay more than $2/bbl for water disposal. The Smart Pump of this invention provides a system that can more slowly remove water at a rate which allows more economical gas and oil production at an optimum rate when disposal cost of brine is considered relative to gas and liquid production sales.

It must be remembered that the slow 300 ft upstroke of this system pulls a continuous vacuum or reduced pressure below the plunger which pulls fluid from the formation by increasing the pressure differential across the perforations P. The rate of plunger travel is maintained at a minimum to keep a maximum vacuum imposed on the perforated side P of the formation F while fluid flows into the bottom of the pump. A large quantity of gas may break out inside the barrel below the plunger during the long slow upstroke. Most pumps could not handle this large quantity of gas due to fluid pounding, whereas the present system, according to this disclosure, works more efficiently with ingested gas for it aids in lifting production fluid as it rises in the tubing and expands all way uphole where it can be collected.

Stripper wells are prone to be problem wells that must have the pumps pulled often because they produce slowly and compound any paraffin problems. Consequently, after the paraffin builds up into a large accumulation that grows worse with time, the tool string usually cannot be pulled without getting stuck when coming out of the hole unless one uses an expensive pulling unit and hot oil truck to melt the hard paraffin substance in order to free the pump. When this condition is encountered with the present system, the paraffin melter HO of FIGS. 1, 4, 14 and 18 is put into operation and the operating cable drum can then be used for pulling the entire tool string through the paraffin build-up.

Figure 18:
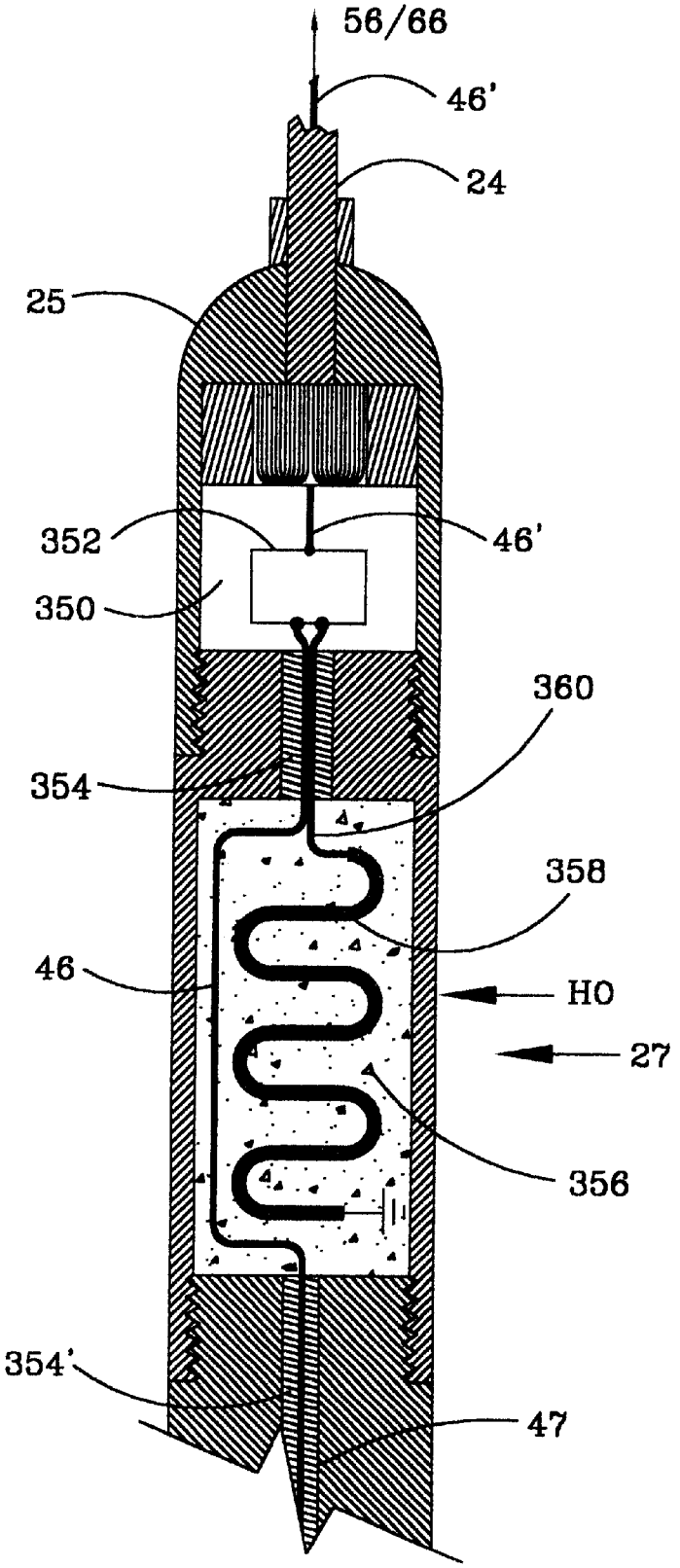
FIG. 18 is a cross sectional representation showing additional details of part of the sinker bar apparatus of FIGS. 1 and 4.

FIG. 18 is a cross sectional representation showing additional details of part of the sinker bar apparatus 27 previously illustrated in FIGS. 1 and 4. The paraffin heater HO of FIG. 18 is located at the upper end of the sinker bar 27 where it is housed below a conventional rope socket 25 that forms the nose of sinker bar 27 and is therefore the first part of the heated tool string to encounter and melt the build up of any blockage due to paraffin problems. Circuitry for the paraffin heating apparatus is enclosed within hermetically sealed chamber 350 which also houses relay device 352. The relay device 352 selectively connects conductor 46' to conductor 46 which leads to either of the downhole sensors (FIG. 13) or alternatively, to the heating element 358 (FIG. 18). Oil filled chamber 356 is spaced from hermetically sealed chamber 350 by the illustrated bulkhead connection at 354 having a seal and an insulator by which conductors 360, 46 sealingly pass there-through. The entrance into opposed axial passageway 47 leading downhole through sinker bar 27 also is sealed at 354'.

The heating element is isolated by the bulkhead connections 354, 354' and houses the heating element 358 therebetween. The heating element is connected between a source of power provided at relay device 352 and a suitable grounded connection, as shown. The circuitry therefor is enclosed within the upper end of the sinker bar, which conveniently always has a nose in the form of a bullet. The paraffin heater circuitry is connected to conductor 46 that emerges from the end of the cable 24 at the illustrated rope socket 25. The conductor 46 can be selectively connected to the paraffin heating element 358 and to the conductor leading downhole to sensors 42-42' by a simple electromechanical relay device 352.

The paraffin heater HO is used to avoid the necessity of hiring an expensive pulling unit and hot oil truck, which, when added to other costs, can make many wells unprofitable. The embodiments of the system of this invention can be manufactured at a cost that often is less than the cost of plugging the well, therefore, it is advantageous to keep the well on line and show a profit in accordance with this disclosure rather than to shut in the well and abandon the potential crude oil production.

Operation

In operation, the before mentioned cable tension measuring device effectively weighs the total weight imposed on idler pulley 50 (of FIGS. 1 and 14) and includes a suitable transducer 54 which provides an appropriate signal to the computer 66 which, together with the control box 58, controls the motor torque and speed in proportion to the measured weight of the produced fluid and the selected predetermined time interval determined by the computer for each cycle of operation for the particular wellbore.

When the apparatus is in operation, the action of the rotating drum shaft of FIG. 17 alternately moves the traveling switch actuator device 69 into engagement with either of the spaced switches 60, 61, thereby alternately commanding the computer to instruct the control box to rotate cable drum 48 in one of the directions of rotation, and consequently pulling in or letting out an appropriate length of cable 24 during a time interval as determined by the computer commands to the control box.

This action of the cable actuated downhole pump system alternately strokes the downhole pump in a slow uphole direction followed by a downstroke during timed sequential cycles of continuous operation. In FIG. 14, the time interval of each stroke of the cycle is determined from stored data in the memory of computer 66. This data is based on the history of the downhole conditions, so that optimum time is appropriately provided to accumulate the required quantity of fluid produced by the formation to fill the pump on the next complete pumping cycle. The computer is programmed to use this data in accordance with this disclosure to provide the most efficient timed cycle for each succeeding round trip of the plunger into the borehole. Hence, the duration of one pumping cycle is equal to the time interval required for the plunger to descend to the bottom of the pump barrel, and then to upstroke at the selected slow rate.

The long time interval of the upstroke is the maximum value consistent with the rate of flow through the downhole casing perforations P. This upstroke time interval is followed by a suitable time interval for the downhole stroke. The length of either of the strokes or of a cycle can be varied, depending on the capacity of the barrel and the duration of the complete cycle which should coincide with the time interval required to fill the barrel with fluid, while making a round trip into the borehole.

At the end of the downstroke and before the beginning of the next upstroke, as the plunger momentarily reaches its lowermost position of travel, the barrel should have become filled with the fluid that was accumulated in the well bore during the previous upstroke trip, and this should be adequate to provide a full barrel. At the end of this timed cycle, the cable drum can be rotated the minimum required to measure the weight of the tool string, or tension of the cable, that is required to lift the plunger without moving the upper check valve from its seat. From this measurement the weight of fluid contained within the barrel is found, and is compared to a dictionary of stored terms in the computer memory that is related to the history of the well production. The barrel should be substantially full according to the measured weight, and an appropriate signal will have been received from sensor 42 that is related or proportional to the fluid level contained within the barrel, which also is related to the weight of fluid that is being produced each cycle of operation. The payload or weight of the contents of the barrel is therefore the weight required to produce the measured tension signal less the tare weight of tool string which equals the weight of the fluid to be lifted by the downhole pump. Hence, the cable drum mechanism winds or pulls in the upper marginal length of the cable in response to the hydraulically actuated winding motor that is driven or powered by the electric motor, all in response to commands from the computer and control box.

The computer and controller is also instructed by the traveling switch actuator device 68 of FIG. 17, for example, as it is moved into engagement with either of spaced switch means 60, 61. This commands control box 58 of FIG. 14 to rotate the drum in one of the directions of rotation, thereby pulling in or letting out the cable at the drum. The controller also receives instructions from the computer related to the weight indicator signal as well as instructions from a dictionary of stored knowledge related to the production history of the wellbore so that the time intervals of the upstroke and downstroke can be calculated and set at a value that keeps the hydrostatic head in front of the casing perforations at a minimum. Hence, the formation fluid is free to flow into the wellbore at all times without being held back by an excessive fluid hydrostatic head, while the plunger continually produces the well during the sequentially calculated time intervals.

On the other hand, the elevation of the fluid level within the casing annulus must be in proximity of the uppermost elevation of the plunger at the end of the upstroke in order for the formation fluid to be ingested by the pump in sufficient quantity to completely fill the barrel. This is because the suction of any pump can normally lift water, for example, only about 29 feet above the elevation of its corresponding fluid head that is to be pumped. Consequently, in the absence of a driving force other than ambient conditions, the fluid level within the annulus must be near the uppermost elevation of the plunger in order for the formation fluid to be ingested by the pump suction and completely fill the barrel. Stated differently, the suction side of a pump plunger can develop at most, a complete vacuum which provides a maximum of about 29 feet (for water) lifting force. Consequently the fluid level in the casing annulus must be at a fluid level respective the top of the barrel to enable the formation fluid to follow the pump plunger to the top of the barrel. Hence, positioning the top of the barrel at a location within the tubing string that is also near or below the top of the annular fluid level within the casing annulus will assure a full barrel on the upstroke in conjunction with the slow moving plunger of this disclosure.

This system can be designed to produce approximately 4 gallons each stroke of the extremely long 100 foot pump barrel, assuming that the pump assembly is received within a standard 2 inch production tubing, for example. Increasing the barrel length to 200 feet will yield a production rate of about 8 gallons per stroke. This provides a production rate of approximately one barrel per five upstrokes or five round trips. Accordingly, one stroke each 6 minutes provides an average rate of recovery of 2 barrels of fluid per hour, or 48 barrels per day. This allows for the average stripper well to have a large oil/water ratio while still economically maintaining a hydrocarbon production rate of approximately 10 barrels of oil per day, along with a large quantity of water.

The fluid discriminator probe 42 of FIG. 13 that detects water level is located adjacent the top of the plunger. This feature, in conjunction with the other sensor circuitry is connected to cause lift to engage only after a predetermined and programmed desired amount of fluid is in the pump barrel. An additional method, as previously discussed, is to pull up with just enough cable tension to take a weight reading. Still another method is the pressure measuring sensor 42' of FIG. 13 which enables calculation of the hydrostatic head of fluid in the barrel. The use of these readings will enable the system to determine how much oil and water is in the barrel, and since the system is programmed to receive a specific quantity of accumulated fluid within the pump barrel, the computer 66 calculates the time interval required during the succeeding cycles of operation for the barrel to be filled to that desired fluid level. During these time intervals the hydraulic pump motor is energized for rotation of the cable drum in the proper direction to slowly upstroke the pump assembly with a full barrel. If the well has not made sufficient fluid to fill the pump barrel, the time interval of the next pumping cycle will be increased until such time delay that the accumulated fluid has reached a desired level in the bottom of the borehole. This difference in time delay will be considered by the computer during the next cycle of operation.

A large savings in electrical costs of lifting or producing fluid from an oil well is realized with this invention because the slow moving pump plunger, together with the ability of the pump to handle gas in a manner to augment the lifting power, and along with the controlled speed of the motor, all harmonize and makes for better use of power and other nonrenewable energy resources.

Another use of the smart pump system is to skim oil off of water in wells that have a high water to oil ratio. Oil rises to the top of water when given adequate time in which to do so. Gas breaks out of the oil and rises above the oil. In many areas water disposal is a costly operation and reduces a considerable part of the hydrocarbon sales. If one can skim the oil from the accumulated downhole fluid and leave the water to act as a means to let the oil move through the column, then the well often could be made to operate more profitably. This is done by adjusting the production rate to a lower value that increases the oil/water ratio while still achieving a profitable production of oil. Hence, in the long run, it may be more profitable to skim the oil downhole to thereby reduce the rate of water production a large amount while reducing the production rate of the oil a small amount; especially when the cost of brine disposal compared to the loss in profit from the lowered oil production justifies this selection of variables.

The smart pump of this disclosure employs a seating nipple at the lower end thereof in which the suction end of the long series connected joints of pump barrels is to be seated. The optimum length of the barrel and plunger stroke can be predetermined by using electric wire line equipment to locate or determine depths where fluid levels stand and where oil/water contact would be after static conditions exist. After installation of the smart pump, each cycle of the pump system detects the oil/water interface using the electric conductivity probe at the top of the plunger. A signal from the conductivity probe is transmitted to the surface by means of an electric conductor located inside the cable which allows reading at the surface to monitor the fluid level as well as the contents of the pump barrel. The location of the downhole pump assembly respective to the elevation of the perforations most often will be dictated by the previous arrangement of the wellbore by the owner. It is not necessary to operate the present invention with the relative position of the perforations being arranged respective the downhole pump as shown in the drawings. It is preferred, however, to produce the formation fluid at the bottom of the well at a rate which keeps a minimum hydrostatic head imposed on the production formation. This happy combination requires a judicious survey of all the downhole conditions along with proper selection of the operating parameters if profits are to be maximized.

When the necessity arises to pull the downhole pump, the following procedure is preferred:

1. Go to manual control mode and lift the plunger to where the upper face of the plunger rests against the lower annular face of the upper standing valve. Pull up or bump up to unseat the anchor device. In the event that the anchor device does not release, then increase the cable tension enough to move the bypass valve element uphole respective to the sleeve thereof to shear the pin. After the pin is sheared, with the upper face of the plunger resting against the lower face of upper standing valve, and equalize the pressure across the equalizing or bypass valve by allowing fluid to flow across the bypass valve which equalizes pressure around the pump barrel.

2. With no more than 500 pounds additional pull, the bottom latch at the seating nipple should release and the pump assembly is ready to be removed from the borehole by spooling the cable uphole.

3. When the seal and bottom latch come out of the seating nipple, a weight loss is expected equivalent to the weight of fluid lowered in the tubing and this will be noted on the weight indicator.

4. Manually operate the winding motor to pull the cable uphole until the cable socket of the tool string reaches the stuffing box at the wellhead.

5. Using proper clamps or stops, begin to disassemble the tool string by first disconnecting the electric conduits from the paraffin heater located at the upper extremity of the sinker bar, thereafter the sinker bar is dissembled, as may be necessary, for removing the upper end of the tool string from the wellhead.

The polish rod would be in 12' joints or lengths, screwed together with thread lock. Each of the rod connections will be heated before being unscrewed to take apart.

6. When the top of the barrel reaches the surface:

a. remove rod bushing guide;

b. remove upper standing valve;

c. pull plunger out of barrel.

d. If repair only to the plunger is to be made, this can be accomplished without breaking down the barrel.

e. If the complete system is to be disassembled, disconnect the barrels one at a time and lay on a rack. The individual barrels will be approximately 30 feet long.

f. If the bypass valve was actuated to the open position it has to be dressed and made ready for the next trip into the borehole.

There is advantage realized when the new smart pump upper standing valve is incorporated into oil wells which make gas. When a considerable amount of gas is being produced along with oil, the gas can accumulate below the plunger as the plunger makes its up-stroke. With conventional pump systems having no upper standing check valve, the total hydrostatic pressure rests on the top side of the ball check valve of the traveling plunger and causes the ball to be slow to open while the gas is being compressed.

The standing valve assembly used in the smart pump of this invention allows a zero hydrostatic pressure above the plunger on its downstroke. This allows gas and oil to pass through the plunger and fill the upper barrel on the downstroke with less effort. Also, the weight required to force fluid (liquid and gas) through the ball and seat of the plunger is much less if the upper standing valve of this disclosure is used. This makes loading the barrel above the plunger much easier even if no gas is present. Therefore, less weight in the form of sinker bars is required to force the plunger down through the fluid on the downstroke.

The upper standing valve of this disclosure is also useful with rod pumps, and is relatively easily installed in existing wells as follows:

1. Assemble as if system is to be run on a wire line.

2. Connect sucker rods along with sinker bars and run pump and land it as you would with a conventional pump barrel.

3. On wells which have gas production along with oil, this system could handle the gas and fluids better since there is no fluid to follow the plunger back to the bottom. Each stroke allows gas to come though the plunger against the barrel pressure instead of the usual tubing hydrostatic head.

4. Spacing and stroke length would be the same as a conventional pump system.

5. On work-over wells, pull the pump so that it can be modified by placing the smart pump upper standing valve at the top of the barrel. Then the rods screwed onto the polish rod as the modified pump is run back into the hole.

Those skilled in the art will appreciate that the hydraulic system used in FIG. 16 advantageously can be replaced with a unit having a variable speed electric motor that is chain driven with a gear box attached to the cable drum, similar in some respects to the embodiment of FIG. 17. The controls for speed and direction can be the same as used in conjunction with the hydraulic system of FIG. 16.

I claim:

1. In a well that extends downhole through a production formation that flows fluid thereinto; a wellhead at the top thereof opposed to the bottom thereof; a production tubing extending from the wellhead downhole within proximity of the formation; an elongate member; a support adjacent the wellhead by which the elongate member is supported for movement along the longitudinal axis of the tubing; a storing device operable in both directions to retrieve and extend said elongate member therefrom;

a well pumping apparatus telescopingly received within the tubing and having a long pump barrel within which a plunger reciprocates for lifting fluid from the bottom of the well up through the tubing and to the wellhead as the plunger upstrokes, and for filling the barrel below the plunger as the plunger upstrokes; means connecting the elongate member to said storage device and to said plunger for reciprocating the plunger;

a control system for responsively lowering and raising the elongate member to thereby slowly remove fluid from the pump barrel during the plunger upstroke and to force formation fluid into the tubing and thereby produce fluid from the well, wherein said well pumping apparatus receives mixed compressible and non-compressible fluids within the barrel; the compressible and non-compressible fluid is lifted up into the tubing string to aerate the fluid column in the tubing string, thereby reducing the density of the fluid in the tubing string which improves production of the well;

said control system comprises a position sensor responsive to plunger position to move said elongate member axially into and out of the well within a selected range of operation; timing means by which the rate of flow from the formation equals the rate of production of the pump apparatus during one cycle of operation; whereby: the plunger is cycled an upstroke followed by a downstroke during a cycle of operation which occurs during an interval of time equal to the rate of fluid flow from the formation to fill the pump barrel with well fluid.

2. The apparatus of claim 1, wherein said control system further includes a weight sensor responsive to tension in the elongate member and connected to provide a signal to said control system to actuate the storing device and move the elongate member into and out of the well during an interval of time that is of a duration to accumulate a full pump barrel of fluid below the plunger on the upstroke; and means responsive to the tension reaching a value representative of the weight of a full pump barrel for moving said elongate member one cycle of operation during said interval of time.

3. The apparatus of claim 1, wherein said plunger includes a traveling valve therein, and said barrel includes an upper and a lower standing valve at opposed ends thereof, whereby, during the upstroke formation fluid is forced into the pump barrel below the plunger, and through the plunger on the downstroke, and thereby forces fluid to be displaced from the barrel into the tubing string each cycle of operation.

4. The apparatus of claim 3, wherein said plunger has a detector means positioned adjacent a face thereof for detecting the presence of a fluid level within the barrel, and means for transmitting data from the detector means uphole to said control means, to provide a signal to which the control system responds by moving the plunger one cycle of operation during a time interval required to accumulate a full pump barrel of fluid in the well.

5. In a well that extends downhole through a production formation from which fluid flows into the well; a wellhead at the top thereof opposed to the bottom thereof; a relatively flexible elongate member, a support adjacent the wellhead by which the elongate member is suspended for movement along the longitudinal axis of the well; a well pumping apparatus having a long pump barrel within which a plunger reciprocates for lifting fluid from the bottom of the well up through a tubing and to the wellhead as the plunger upstrokes and concurrently filling the barrel as the plunger upstrokes;

a storing device operable in both directions to retrieve and extend said elongate member respective thereto wherein the member extends from the support into the well and is connected to provide a means for reciprocating the plunger;

and a control system for responsively actuating the storage device in alternate directions and thereby lowering and raising the elongate member for stroking said plunger uphole and downhole during one cycle of operation to slowly remove fluid from the pump barrel during the plunger upstroke and to force formation fluid into the tubing and thereby produce fluid from the well;

said control system comprises a position sensor responsive to plunger position to move said elongate member axially into and out of the well and means coordinating the time interval of one cycle of pump operation to coincide with a time interval for the well to make a quantity of fluid that represents a full pump barrel.

6. The apparatus of claim 5, wherein said control system further includes a weight sensor responsive to tension in the elongate member and connected to provide a signal to said control system to actuate the storing device and move the elongate member into and out of the well during an interval of time that is of a duration to accumulate a full pump barrel of fluid below the plunger on the upstroke; and means responsive to the tension being a value representative of the weight of a full pump barrel for moving said member during said interval of time.

7. The apparatus of claim 5, wherein said barrel is telescopingly received within a tubing string for translocating fluid produced by the plunger uphole to the surface, said plunger includes a traveling valve, and said barrel includes an upper and a lower standing valve at opposed ends thereof, whereby, during the upstroke of the plunger formation fluid is forced into the pump barrel below the plunger; and, through the plunger on the downstroke and thereby forces fluid to be displaced into the tubing string each cycle of operation, a sinker bar having an upper end connected to said elongate member and a lower end connected to actuate the plunger, heating means within the upper end of said sinker bar for melting an accumulation of paraffin encountered when pulling the pump assembly from the tubing.

8. The apparatus of claim 7, wherein said plunger has a detector means positioned in proximity of an upper face thereof for detecting the presence of a fluid level within the barrel, and means for transmitting data from the detector means uphole to said control means, to provide a signal to which the control system responds by moving the plunger one cycle of operation during a time interval required to accumulate a full pump barrel of fluid in the well.

9. In a well having a production formation that flows fluid thereinto; a wellhead at the top thereof opposed to the bottom thereof; a cable support adjacent the wellhead by which a cable is suspended for movement along the longitudinal axis of the well; a well pumping apparatus having a long pump barrel within which a plunger is reciprocatingly received, means by which the plunger is reciprocated by said cable for lifting fluid from the bottom of the well up through a tubing and to the wellhead;

a cable storing device operable to move the cable in both directions to retrieve and extend the cable therefrom wherein the cable extends from the cable support into the well; and means connecting the cable to reciprocatingly actuate the plunger of the well pumping apparatus;

a prime mover connected to actuate said cable storing device for alternate change in direction of travel of the cable during each cycle of operation thereof;

and a control system for responsively lowering and raising the cable to actuate the plunger to slowly remove fluid from the pump barrel each upstroke of the plunger and thereafter downstroke the plunger to force fluid into the barrel above the plunger and thereby produce fluid from the well borehole each cycle of operation at the same rate fluid flows from the formation into the well.

10. The apparatus of claim 9 wherein said control system comprises a position sensor responsive to cable position to move said cable axially into and out of the well; said barrel is releasably affixed to said tubing by a pump hold down in the form of an anchor and seating arrangement; a bypass valve attached between the pump barrel and the anchor for bypassing fluid from the tubing to the suction side of the pump when actuated to the open position upon lifting the barrel respective the seating arrangement.

11. The apparatus of claim 9 wherein said control system further includes a weight sensor responsive to cable tension and connected to move the cable into and out of the well during an interval of time of a duration to accumulate a full barrel of fluid below the plunger on the upstroke; and means responsive to a cable tension value that is representative of the weight of a full pump barrel for moving said cable during said interval of time; and, a sinker bar having an upper end connected to said cable and a lower end connected to actuate the plunger, heating means within the upper end of said sinker bar for melting an accumulation of paraffin encountered when pulling the pump assembly from the tubing.

12. The apparatus of claim 9 wherein said barrel is received within a tubing string for translocating fluid produced by the plunger uphole to the wellhead, said plunger includes a traveling valve, and said barrel includes an upper and a lower standing valve at opposed ends thereof by which formation fluid is forced into the barrel below the plunger on the upstroke and the plunger moves through the fluid on the downstroke, whereupon fluid is displaced into the tubing string each cycle of operation.

13. The apparatus of claim 12 wherein said plunger has a detector means positioned to contact fluid adjacent an upper face thereof for detecting the presence of a fluid level within the barrel, and means for transmitting data from the detector means uphole to the control system.

14. The apparatus of claim 9 wherein said well pumping apparatus receives mixed compressible and non-compressible fluids within the barrel which are lifted up the tubing string to aerate the fluid column in the tubing string, thereby reducing the density of the fluid in the tubing string to improve the production of the well.

15. The apparatus of claim 14 wherein said control system comprises a cable weight sensor which cooperates with control means connected to said cable storing device to control the duration of each upstroke and downstroke and thereby control the filling of said barrel with the formation fluids.

16. The apparatus of claim 9 wherein said control system comprises a cable weight sensor and a fluid level sensor which cooperates with said control system to control the filling of said pump barrel with said formation fluids.

17. The apparatus of claim 9 wherein said cable storing device is a motor driven rotatable drum that receives said cable; said motor is operated by said control system; and said barrel is made of a plurality of lengths of tubular products attached in series relationship;

said plunger is attached to said cable by a hollow polish rod, a sensor adjacent the plunger, and a conductor connected to said sensor and extends uphole through the hollow polish rod and to the surface for transmitting downhole data uphole to said control system.

18. The apparatus of claim 17 wherein said prime mover is an electric motor connected to rotate the drum to control the cable tension to enhance cable winding on said drum, and a cable tensiometer connected to transfer tension data to the control system to energize the motor and move the plunger uphole when the tension is within the range of predetermined values.

19. A method of producing a stripper well extending through a fluid producing formation located downhole respective the wellbore, comprising the steps of:

step 1. supporting a long pump assembly having a barrel and a plunger downhole in the wellbore; reciprocatingly receiving the plunger within the barrel of the pump assembly, telescopingly receiving the barrel within a tubing string connected to a wellhead which is located at the top of the well; providing the barrel with a lower standing valve at the lower end thereof and an upper standing valve at the upper end thereof, and providing the plunger with a traveling valve therewithin for supporting a fluid column in the barrel and the tubing string on the upstroke of the plunger;

step 2. Supporting a fluid column in the tubing string with said upper standing valve on the downstroke of the plunger;

step 3. filling the lower end of the barrel below the plunger with well fluid by raising the plunger in response to the elevation of the liquid level in the well wherein the well fluid includes both compressible and non-compressible fluid;

step 4. actuating the pump by slowly cyclically reciprocating the plunger within a range of positions between the upper and lower ends of the barrel, thereby forcing fluid from the barrel into the tubing string and up to the wellhead; and thereafter lowering the plunger to a position near the lower end of the barrel, thereby positioning the plunger adjacent the lower end of the barrel;

step 5. raising and lowering the plunger controllably responsive to the quantity of fluid contained within the barrel; and, expelling compressible fluid entering the pump up the tubing string to enhance lifting fluid uphole each cycle of operation.

20. The method of claim 19, including the steps of positioning the pump in proximity of the formation, and reciprocating the plunger with an elongate member which is moved in opposite directions to stroke the plunger in response to instructions from a controller means connected to determine the time interval of raising and lowering the plunger.

21. The method of claim 19 and further including the steps of operating the well while measuring the upstroke time, downstroke time, weight of full barrel, weight of empty barrel, fluid level and conductivity of the barrel contents, to thereby provide a dictionary of stored terms; and, reciprocating the plunger at a rate based on the stored terms which produces the well to remove fluid therefrom at substantially the rate of fluid flow from the formation into the well.

22. The method of claim 21, wherein the fluid flowing into the bottom of the well from the formation includes oil and water, and further including the steps of: measuring the elevation of the interface between oil and water in the pump barrel responsive to a sensor means affixed to an end of the plunger and thereafter removing the oil contained in the barrel.

23. The method of claim 19 and further including the step of pumping the well down to its minimum level each cycle of operation responsive to the quantity of fluid contained in the barrel on a previous stroke, while flowing liquid and gas into the pump barrel; lifting liquid and gas up through the pump barrel each upstroke of the pump to thereby reduce the density of the liquid contained in the tubing above the pump which aids in producing the well.

24. Method of skimming oil from formation fluid located in a lower end of a borehole containing oil, water and gas, comprising the steps of:

step 1. removably connecting a relatively long pump assembly downhole in the borehole within a production tubing string attached to a well head;

step 2. controllably and reciprocatingly receiving a plunger within a barrel of the pump assembly at a relatively slow rate of cyclical operation;

step 3. arranging a lower standing valve at the lower end of the barrel through which fluid is forced to flow into the barrel below the plunger during an upstroke, and an upper standing valve at the upper end of the barrel for supporting a fluid column in the tubing string on a downstroke, and, providing the plunger with a traveling valve therewithin for supporting a fluid column in the barrel on the upstroke;

step 4. determining the location of an interface between oil and water in the barrel by connecting a downhole sensor means to the plunger and stopping the plunger near the interface on subsequent cycles of operation, while reciprocating the plunger within the barrel at a rate responsive to the rate of accumulation of oil contained in the fluid until a preset oil/water ratio is attained each cycle of the pumping operation;

step 5. upstroking the plunger while filling the barrel below the plunger with well fluid including both compressible and non-compressible fluids;

step 6. continuously producing the well while determining the oil/water ratio of fluid contained in the barrel during a cycle of operation comprising: slowly upstroking the plunger to a position near the upper end of the barrel, thereby forcing fluid to flow up the tubing string to the wellhead while fluid flows into the barrel below the plunger; and, thereafter downstroking the plunger through the fluid in the barrel to a position near the lower end of the barrel;

step 7. controllably raising and lowering the plunger during each cycle during a time interval which is changed responsive to the filling of the barrel to attain said preset oil/water ratio, and; expelling compressible fluid entering the pump up the tubing string to enhance lifting produced fluid in the barrel each cycle of operation.

25. The method of claim 24, including the steps of positioning an inlet to the pump in proximity of the fluid level in the well during continuous operation of the pump assembly, and cycling the plunger at a cyclic rate that allows oil and water in the well to separate prior to entering the pump barrel.

26. The method of claim 25, including the step of reciprocating the plunger with a cable wound onto a cable drum and rotated in opposite directions to stroke the plunger in response to accumulation of a sufficient quantity of fluid required to fill the pump barrel with oil and gas on the upstroke of the plunger.

27. The method of claim 24, including the step of accumulating compressible fluid within the pump barrel and subsequently forcing compressible fluid out of the pump barrel each up stroke of the pump plunger and thereby reducing the density of the liquid contained within the production tubing above the pump barrel to aid producing the well.

28. The method of claim 25, wherein step 7 is carried out by operating the well at said cyclical rate while measuring the production rate of fluid produced by the formation and thereby provide a dictionary of stored terms related to upstroke time, downstroke time, cable tension of full barrel, cable tension of empty barrel, fluid level in barrel, and using said dictionary of stored terms for selecting the optimum cyclical rate at which the plunger is reciprocated within the barrel in order to remove well fluid at the same rate it accumulates in the borehole.

29. The method of claim 24 and further including the step of determining the interface between the oil and water by a conductivity probe affixed adjacent a face of the plunger to measure the conductivity of the formation fluid that flows into the bottom of the pump assembly to fill the barrel, and, upstroking the plunger from a location adjacent the interface to force the oil from the pump barrel.

30. The method of claim 24 and further including the step of pumping the well down to its minimum fluid level during sequential cycles of operation while flowing liquid and gas into the pump barrel; lifting compressible fluid up through the pump barrel each stroke of the pump to thereby expel both liquid and gas from the barrel, while reducing the density of the liquid contained in the tubing above the pump which aids in producing the well.

31. A method of producing a stripper well comprising the steps of:

step 1. arranging a long stroking pump assembly having a barrel downhole within a tubing string of a stripper well; the barrel having a standing valve at the lower end thereof, a stationary valve at the upper end of the barrel for supporting a fluid column within the tubing string; and a plunger having a traveling valve associated therewith is reciprocatingly received within the barrel for lifting formation fluid uphole; and, step 2. upstroking and downstroking the plunger respective the barrel in response to movement of a cable operated from the surface and connected to reciprocate the plunger to fill the barrel with well fluid on the upstroke of the plunger wherein the well fluid includes both compressible and non-compressible fluid;

step 3. producing the well by upstroking the plunger to a position near the upper end of the barrel, thereby forcing fluid in the barrel above the plunger to flow up the tubing string to the wellhead;

step 4. raising and lowering the plunger controllably in response to the rate of production needed to keep the well pumped down, and, expelling compressible fluid entering the pump up the tubing string to enhance lifting produced fluid.

32. The method of claim 31, wherein the well is cased and perforated, and further including the step of positioning the upper end of the pump barrel at an elevation in proximity of the casing perforations whereby well fluid flows into the suction end of the pump during an upstroke at a rate which lowers the hydrostatic head at the perforations to a minimum; and, further including the steps of removably attaching the pump assembly to a pump hold down device and pulling said pump assembly to the surface by upstroking the plunger into engagement respective the upper end of the pump barrel by tensioning the cable, whereupon the pump is released from the hold down device and brought to the surface;

and further including a paraffin melting device arranged adjacent the top of the tool string for melting paraffin encountered within the tubing string as the pump assembly is pulled uphole to the surface.

33. The method of claim 31, and further including the step of producing the well at a rate that is substantially equal to the rate of flow of fluid from the fluid producing formation of the borehole while concurrently lowering the liquid level in the borehole to a minimum, and lifting compressible fluid up through the pump barrel each upstroke of the pump plunger and thereby reduce the density of the liquid contained in the tubing above the pump which aids in producing the well.

* * * * *